US010259239B2

(12) United States Patent
Hojo

(10) Patent No.: US 10,259,239 B2
(45) **Date of Patent: *Apr. 16, 2019**

(54) PRINTING APPARATUS, PRINTING METHOD AND NON-TRANSITORY RECORDING MEDIUM STORING PRINTING PROGRAM

(71) Applicant: Brother Kogyo Kabushiki Kaisha, Nagoya-shi, Aichi-ken (JP)

(72) Inventor: Kazuma Hojo, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/106,178

(22) Filed: Aug. 21, 2018

(65) Prior Publication Data

US 2018/0354279 A1 Dec. 13, 2018

Related U.S. Application Data

(63) Continuation of application No. 15/712,199, filed on Sep. 22, 2017, now Pat. No. 10,105,973.

(30) Foreign Application Priority Data

May 31, 2017 (JP) ..... 2017-107710

(51) Int. Cl.
*B41J 15/08* (2006.01)
*B41J 13/00* (2006.01)
(Continued)

(52) U.S. Cl.
CPC ..... *B41J 13/0009* (2013.01); *B41J 2/32* (2013.01); *B41J 11/04* (2013.01); *B41J 11/42* (2013.01);
(Continued)

(58) Field of Classification Search
CPC ..... B41J 15/04
See application file for complete search history.

(56) References Cited

U.S. PATENT DOCUMENTS 8,454,251 B2 6/2013 Bhatia et al.

FOREIGN PATENT DOCUMENTS

JP 2001-270205 A 10/2001
JP 2009-067055 A 4/2009
(Continued)

OTHER PUBLICATIONS

U.S. Appl. No. 15/712,199, filed Sep. 2017, Hojo.*

*Primary Examiner* — Huan H Tran
(74) *Attorney, Agent, or Firm* — Banner & Witcoff, Ltd.

(57) ABSTRACT

There is provided a printing apparatus including: a frame; a platen facing a thermal head; a moving mechanism having first and second rollers; a motor; a transmitting mechanism; a clutch provided on the transmitting mechanism; a communication interface performing communication with an external apparatus; and a controller. The controller is configured to: start the driving of the motor toward one direction in a state that the clutch is in the connected state, after receiving a print signal, indicating that the print medium is located at a printable position; and to allow the clutch to be in a cutoff state and stop the driving of the motor toward the one direction, after ending of printing in accordance of the receiving of the print signal and before arrival of the moving mechanism at an end on a second side, opposite to the first side, in the specified direction of the moving range.

8 Claims, 21 Drawing Sheets

(51) Int. Cl.

| | |
|---|---|
| ***B41J 11/04*** | (2006.01) |
| ***B41J 2/32*** | (2006.01) |
| ***B41J 15/12*** | (2006.01) |
| ***B41J 11/42*** | (2006.01) |
| ***B41J 15/04*** | (2006.01) |

(52) U.S. Cl.
CPC ..... *B41J 15/04* (2013.01); *B41J 15/12* (2013.01); *B41J 15/08* (2013.01)

(56) References Cited

FOREIGN PATENT DOCUMENTS

| | | | |
|---|---|---|---|
| JP | 2015-199205 | A | 11/2015 |
| JP | 5935042 | B2 | 6/2016 |

* cited by examiner

PRINTING APPARATUS, PRINTING METHOD AND NON-TRANSITORY RECORDING MEDIUM STORING PRINTING PROGRAM

CROSS REFERENCE TO RELATED APPLICATION

The present application is a continuation of U.S. patent application Ser. No. 15/712,199, filed Sep. 22, 2017, which claims priority from Japanese Patent Application No. 2017-107710 filed on May 31, 2017 the disclosures of which are incorporated herein by reference in their entirety.

BACKGROUND

Field of the Invention

The present disclosure relates to a printing apparatus, a printing method and a non-transitory recording medium storing the printing program.

Description of the Related Art

There is known a printing apparatus configured to perform printing with respect to a print medium (packaging material, label, etc.) which is conveyed by a conveying apparatus such as a packaging machine, etc. Further, a technique for controlling a conveying velocity at a part or portion, of the print medium, at which printing by the printing apparatus is performed (hereinafter referred to as a "print position velocity") is also suggested. There is known a printing apparatus including a stand (rack, also referred to as a "moving mechanism") and a stepping motor. The moving mechanism has a guide roller guiding a print medium. The stepping motor moves the moving mechanism in a direction "a" or a direction "b" along a guide rail. The print position velocity is decelerated in response to movement of the rack in the direction "a" and is accelerated in response to movement of the rack in the direction "b".

SUMMARY

According to a first aspect of the present disclosure, there is provided a printing apparatus configured to perform printing on a print medium, including: a frame; a platen supported by the frame and configured to face a thermal head configured to perform printing on the print medium; a moving mechanism supported by the frame to be movable in a moving range along a specified direction. The moving mechanism has: two rollers configured to guide the print medium, the two rollers being a first roller which is positioned, with respect to the platen, on an upstream side of a conveyance path of the print medium, and a second roller which is positioned, with respect to the platen, on a downstream side of the conveyance path; and a supporting member configured to rotatably support the first roller and the second roller. The moving mechanism is configured such that a part, of the conveyance path, between the platen and the first roller becomes short in a case that the moving mechanism is moved toward a first side in the specified direction, and the part, of the conveyance path, between the platen and the first roller becomes long in a case that the moving mechanism is moved toward a second side, opposite to the first side, in the specified direction. The printing apparatus further includes: a motor provided on the frame; a transmitting mechanism which is connected to the motor and the moving mechanism, which is configured to move the moving mechanism toward the first side in accordance with driving of the motor toward one direction; a clutch which is provided on the transmitting mechanism, via which a driving force of the motor is transmitted to the moving mechanism in a case that the clutch is in a connected state, and via which the driving force is not transmitted to the moving mechanism in a case that the clutch is in a cutoff state; a communication interface configured to perform communication with an external apparatus; and a controller configured to execute: starting the driving of the motor toward the one direction in a state that the clutch is in the connected state, after receiving a print signal, indicating that the print medium is located at a printable position, from the external apparatus via the communication interface, and allowing the clutch to be in the cutoff state and stopping the driving of the motor toward the one direction, after ending of printing in accordance of the receiving of the print signal and before arrival of the moving mechanism at an end on the second side of the moving range.

According to a second aspect of the present disclosure, there is provided a printing method including: starting driving of a motor toward one direction in a state that a clutch provided on a transmitting mechanism is in a connected state and moving a moving mechanism, which is configured to be movable in a moving range along a specified direction, toward a first side in the specified direction, after receipt of a print signal, indicating that a print medium is located at a printable position, from an external apparatus. The transmitting mechanism connects the moving mechanism and the motor. The moving mechanism has: a first roller which is positioned, with respect to a platen configured to face a thermal head, on an upstream side of a conveyance path of the print medium, and a second roller which is positioned, with respect to the platen, on a downstream side of the conveyance path. The moving mechanism is configured such that a part, of the conveyance path, between the platen and the first roller becomes short in a case that the moving mechanism is moved toward the first side in the specified direction, and the part, of the conveyance path, between the platen and the first roller becomes long in a case that the moving mechanism is moved toward a second side, opposite to the first side, in the specified direction. The printing method further includes: allowing the clutch to be in a cutoff state and stopping the driving of the motor toward the one direction, after ending of printing in accordance of the receipt of the print signal and before arrival of the moving mechanism at an end on the second side of the moving range.

According to a third aspect of the present disclosure, there is provided a non-transitory computer readable storage medium storing a printing program for causing a computer of a printing apparatus to execute: starting driving of a motor toward one direction in a state that a clutch provided on a transmitting mechanism is in a connected state and moving a moving mechanism, which is configured to be movable in a moving range along a specified direction, toward a first side in the specified direction, after receipt of a print signal, indicating that a print medium is located at a printable position, from an external apparatus. The transmitting mechanism connects the moving mechanism and the motor. The moving mechanism has: a first roller which is positioned, with respect to a platen configured to face a thermal head, on an upstream side of a conveyance path of the print medium, and a second roller which is positioned, with respect to the platen, on a downstream side of the conveyance path. The moving mechanism is configured such that a part, of the conveyance path, between the platen and the first roller becomes short in a case that the moving mechanism is moved toward the first side in the specified direction, and the part, of the conveyance path, between the platen and the first roller becomes long in a case that the moving mechanism is moved toward a second side, opposite to the first side, in the specified direction. The program causes the computer of the printing apparatus to execute: allowing the clutch to be in a cutoff state and stopping the driving of the motor toward the one direction, after ending of printing in accordance of the receipt of the print signal and before arrival of the moving mechanism at an end on the second side of the moving range.

BRIEF DESCRIPTION I/F THE DRAWINGS

Figure 11A:
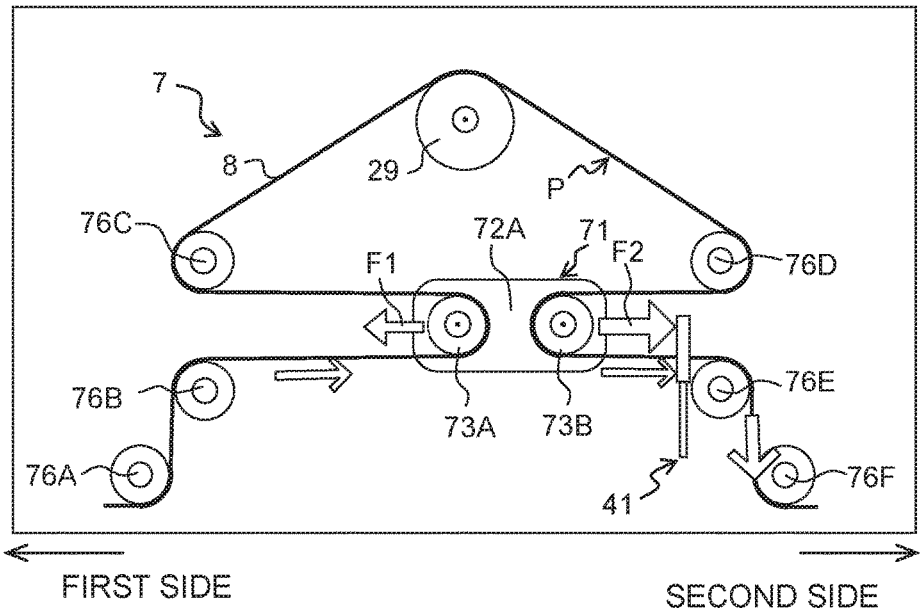
Figure 11B:
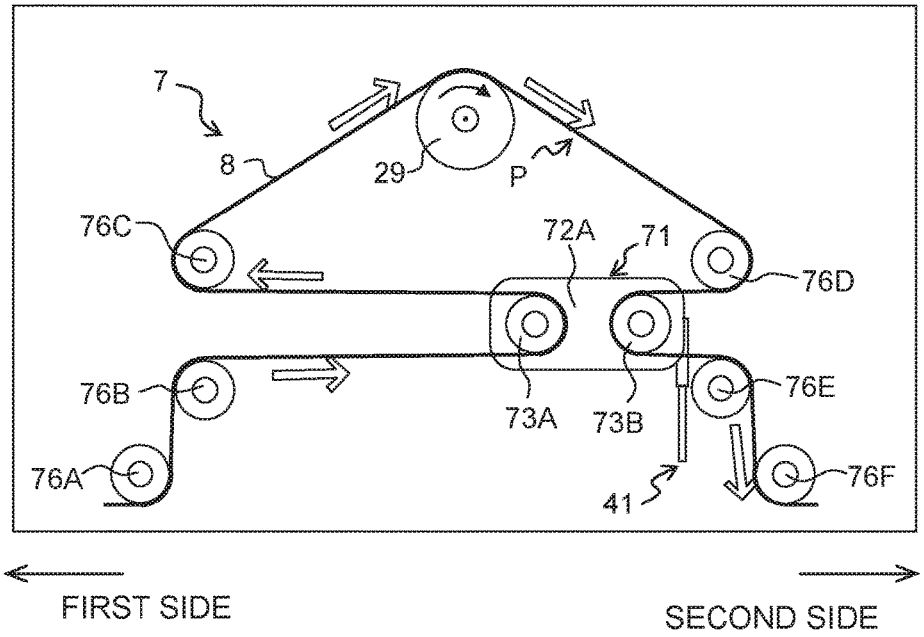

FIGS. 11A and 11B are views for explaining a situation in which the moving mechanism 71 is moved in a state that a print medium 8 is (being) conveyed by an external apparatus 100.

Figure 12A:
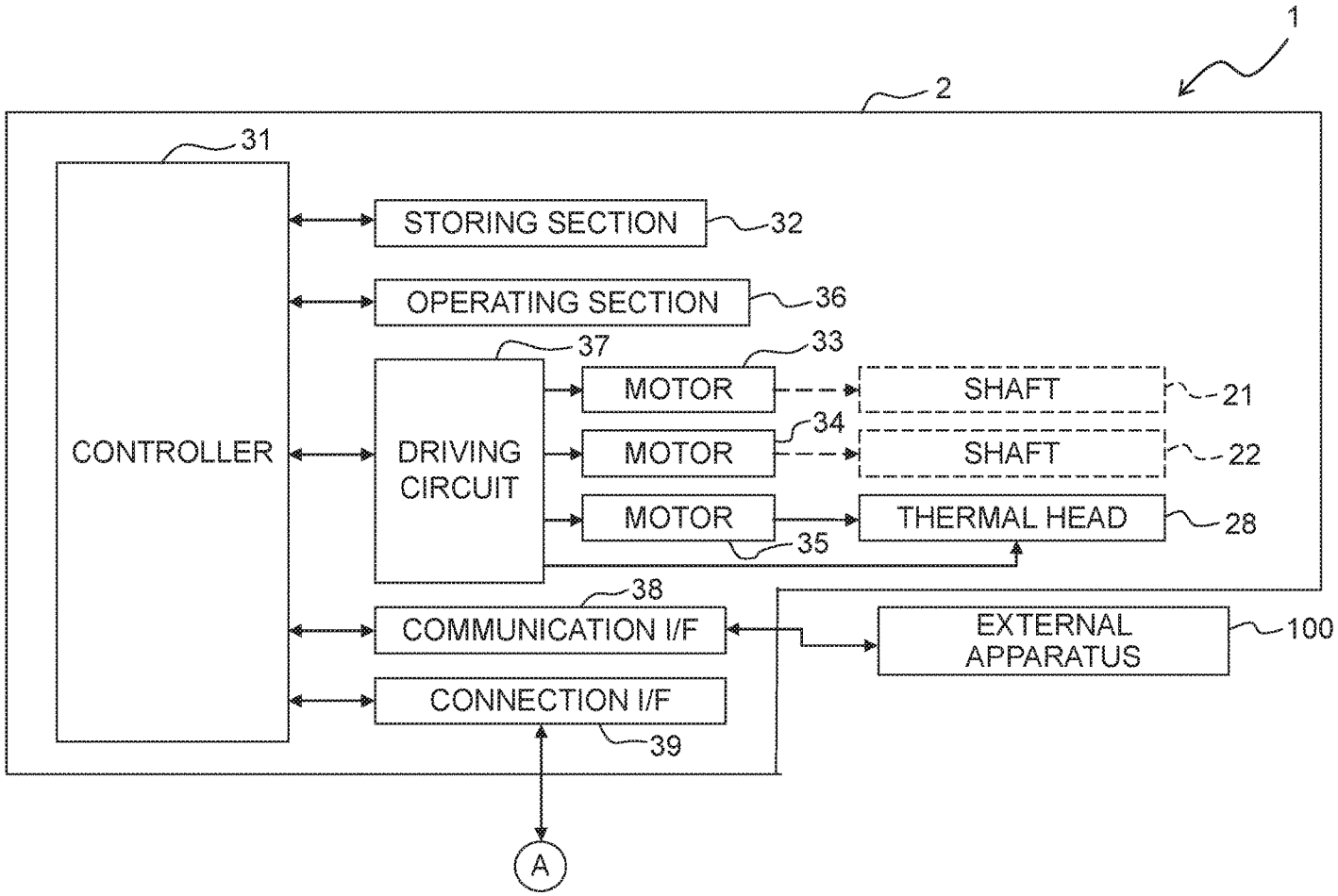
Figure 12B:
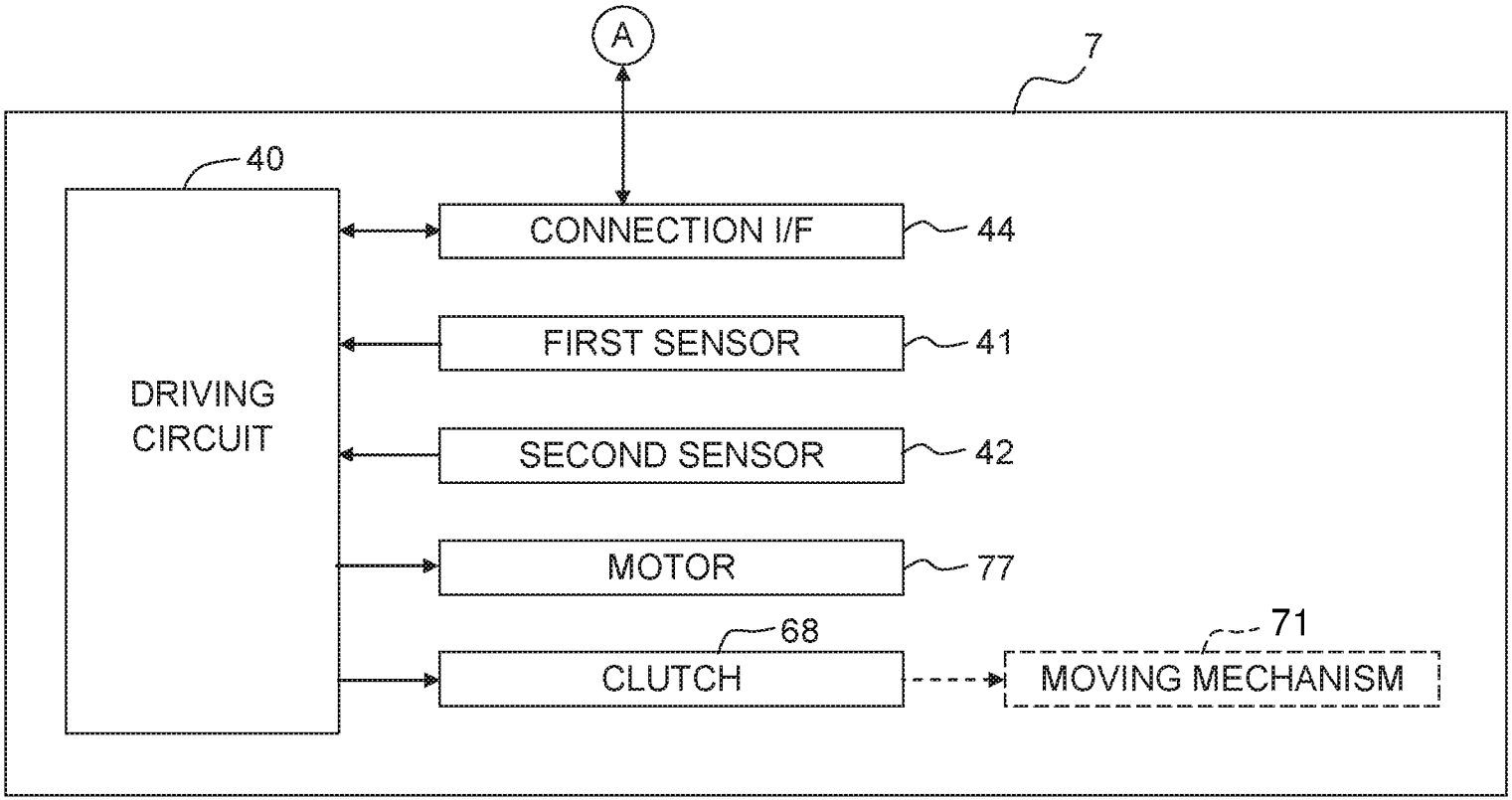

FIGS. 12A and 12B are block diagrams depicting the electrical configuration of the printing apparatus 1.

Figure 13A:
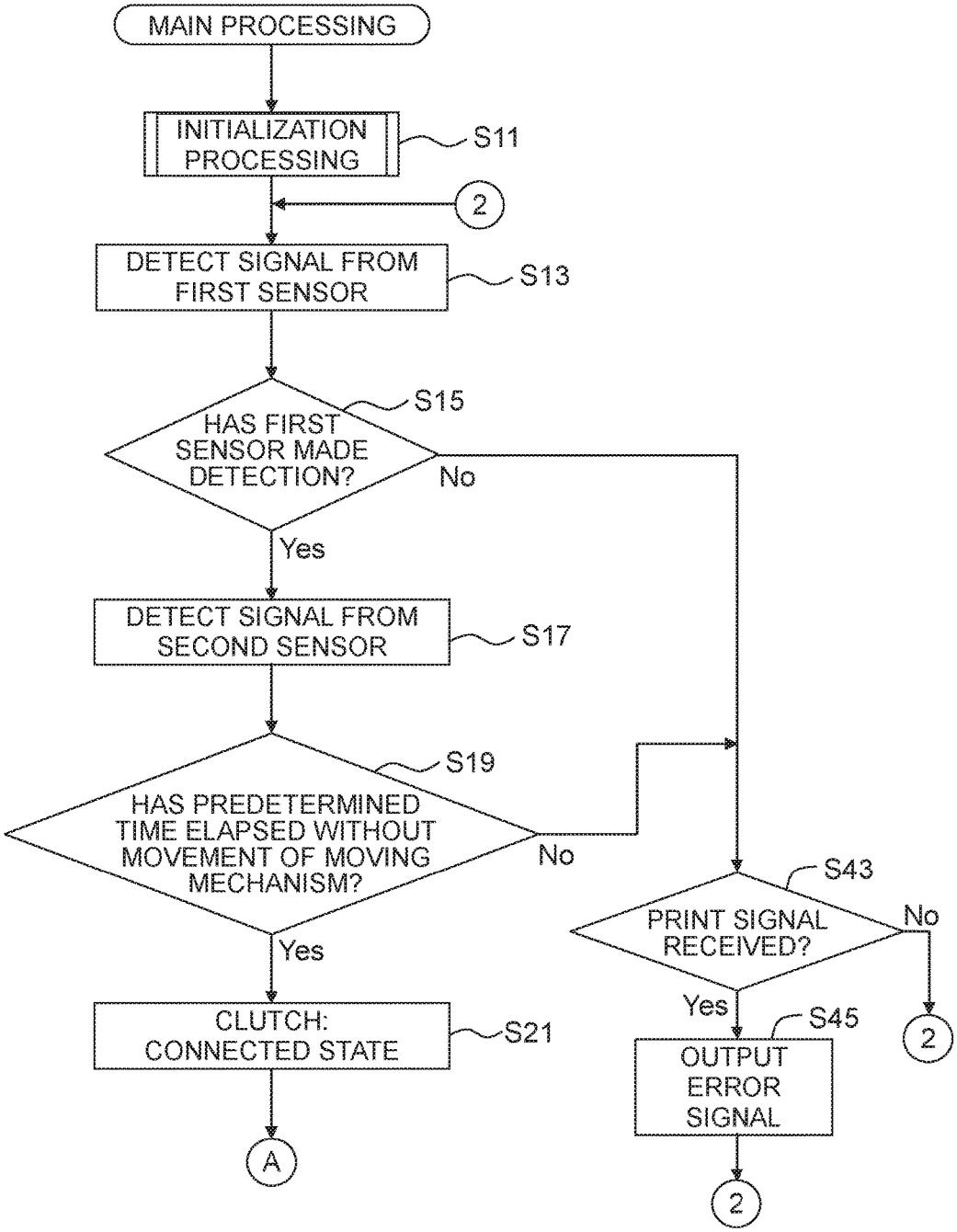
Figure 13B:
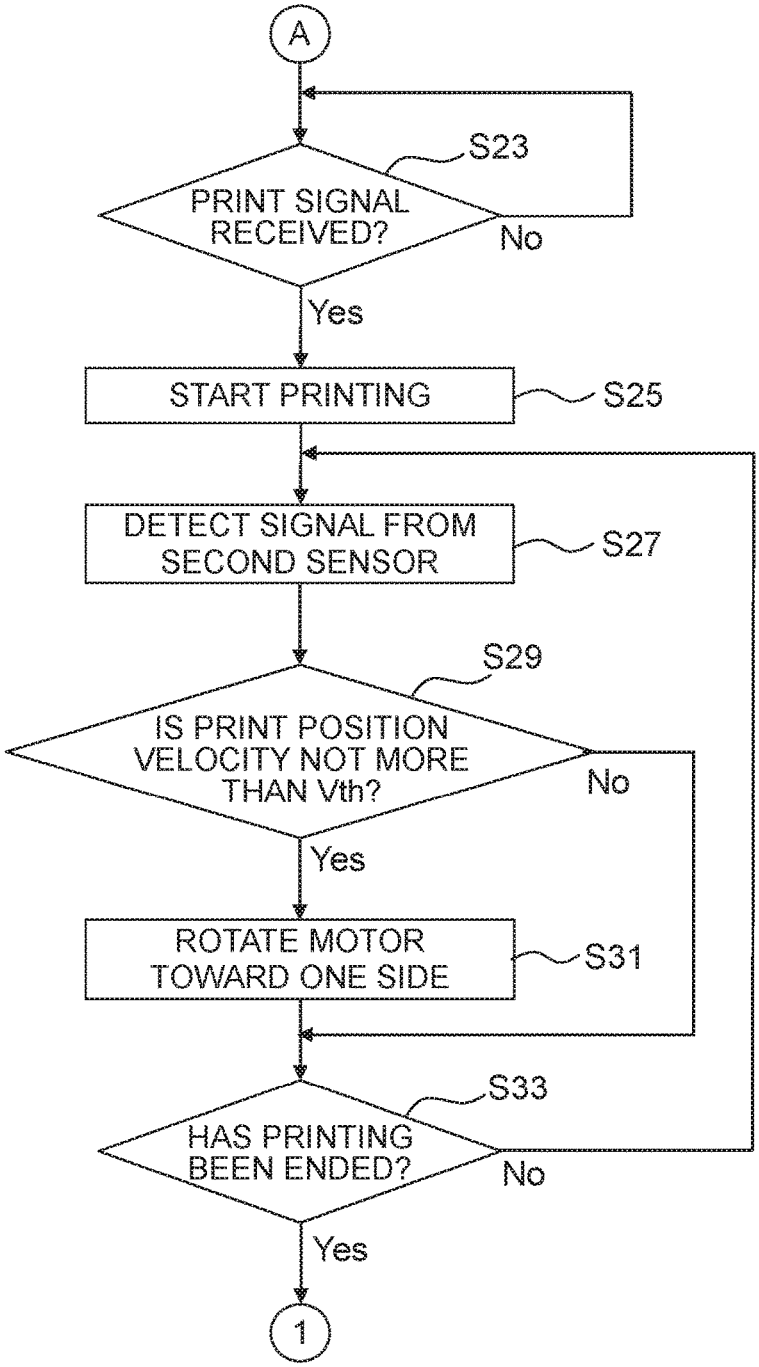

FIGS. 13A and 13B are flow charts of a main processing.

Figure 14:
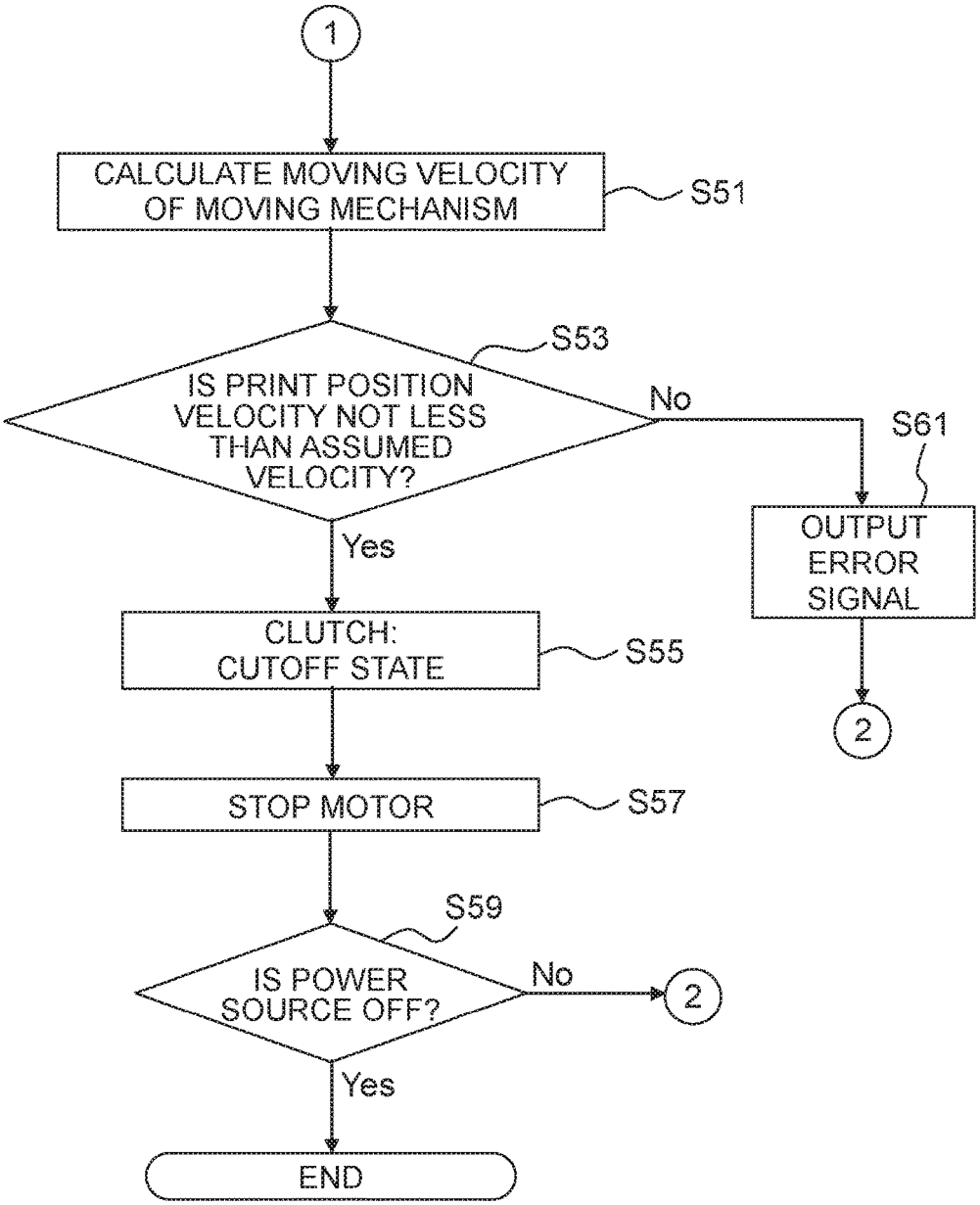

FIG. 14 is a flow chart of the main processing, continued from FIG. 13B.

Figure 15A:
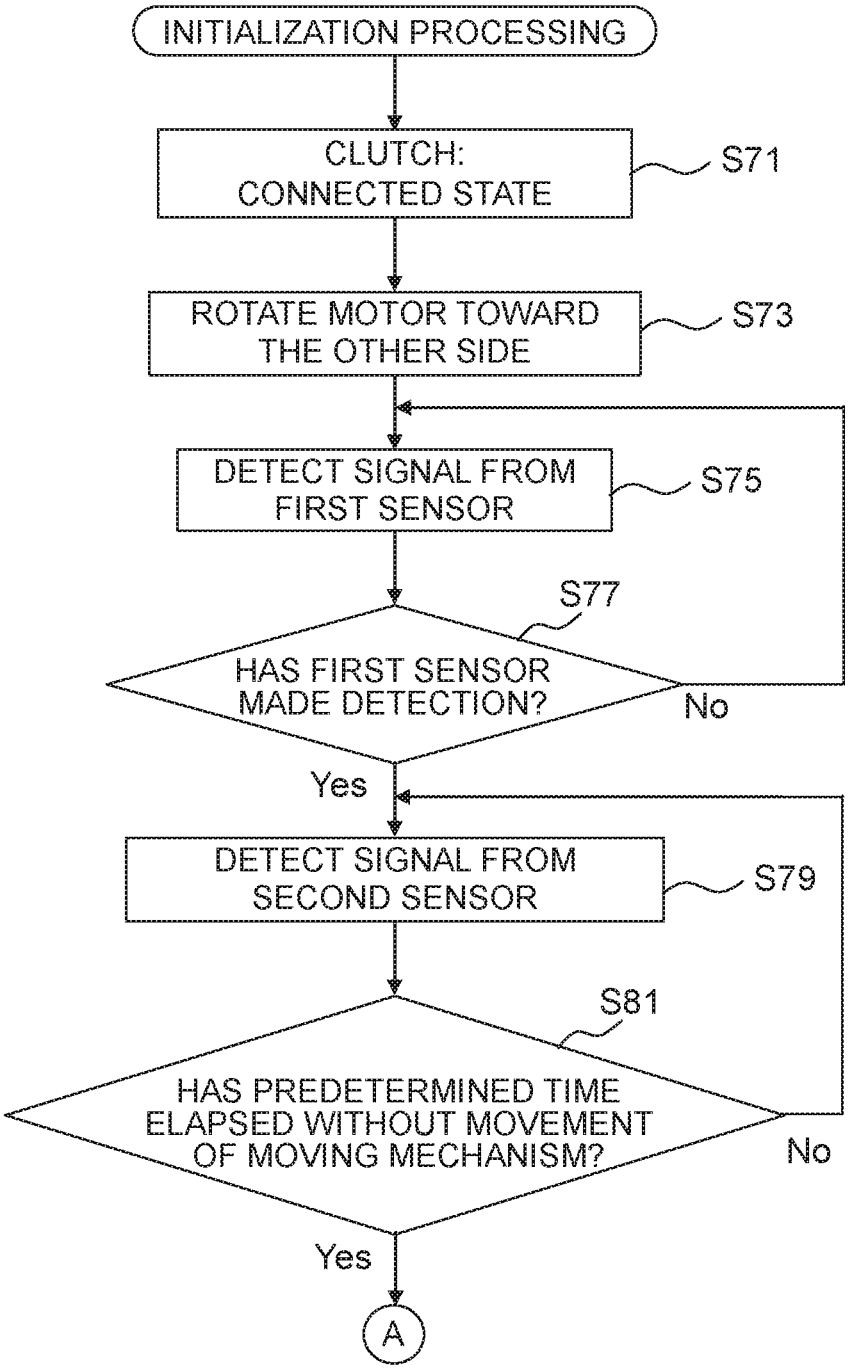
Figure 15B:
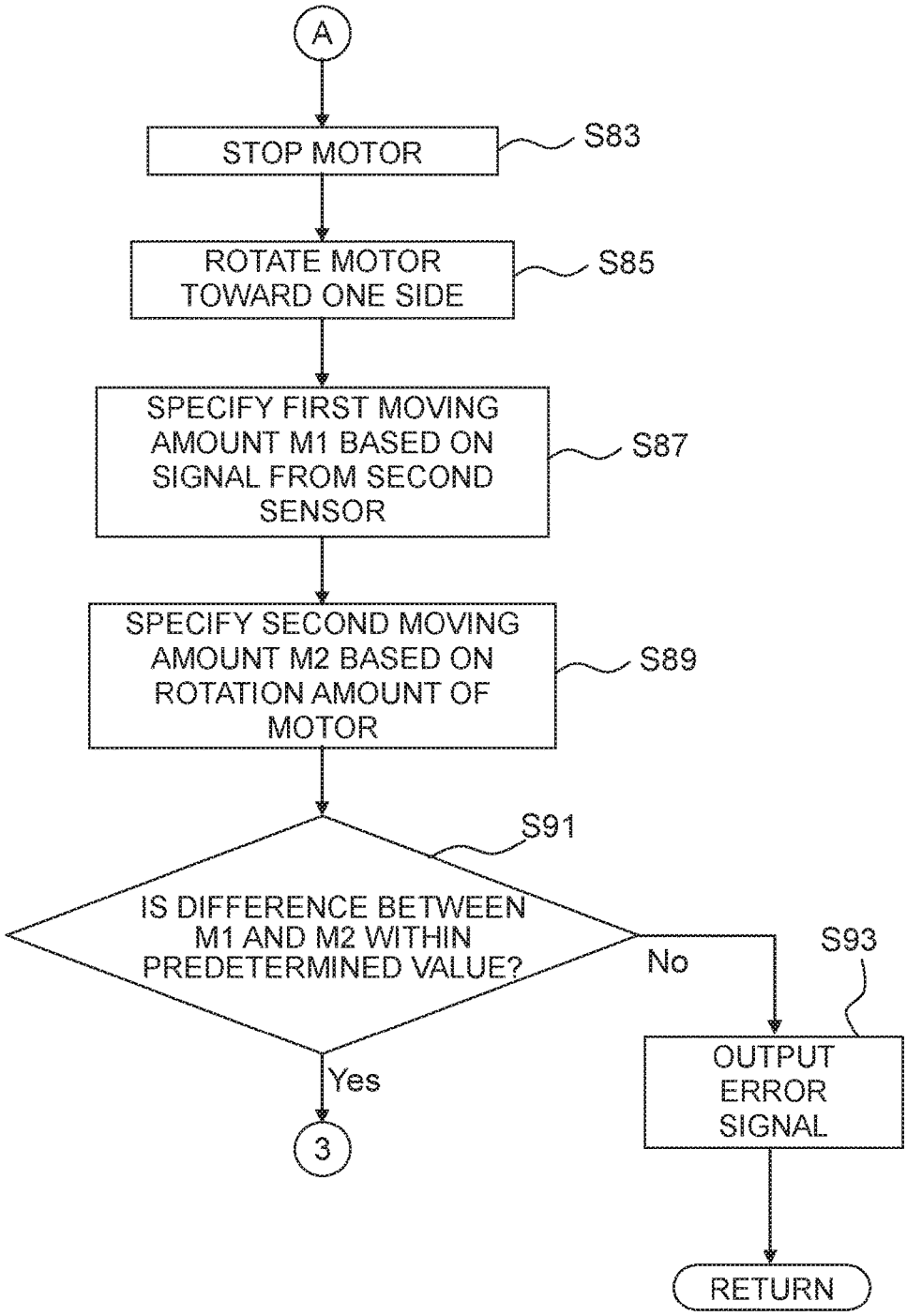

FIGS. 15A and 15B are flow charts of an initialization processing.

Figure 16:
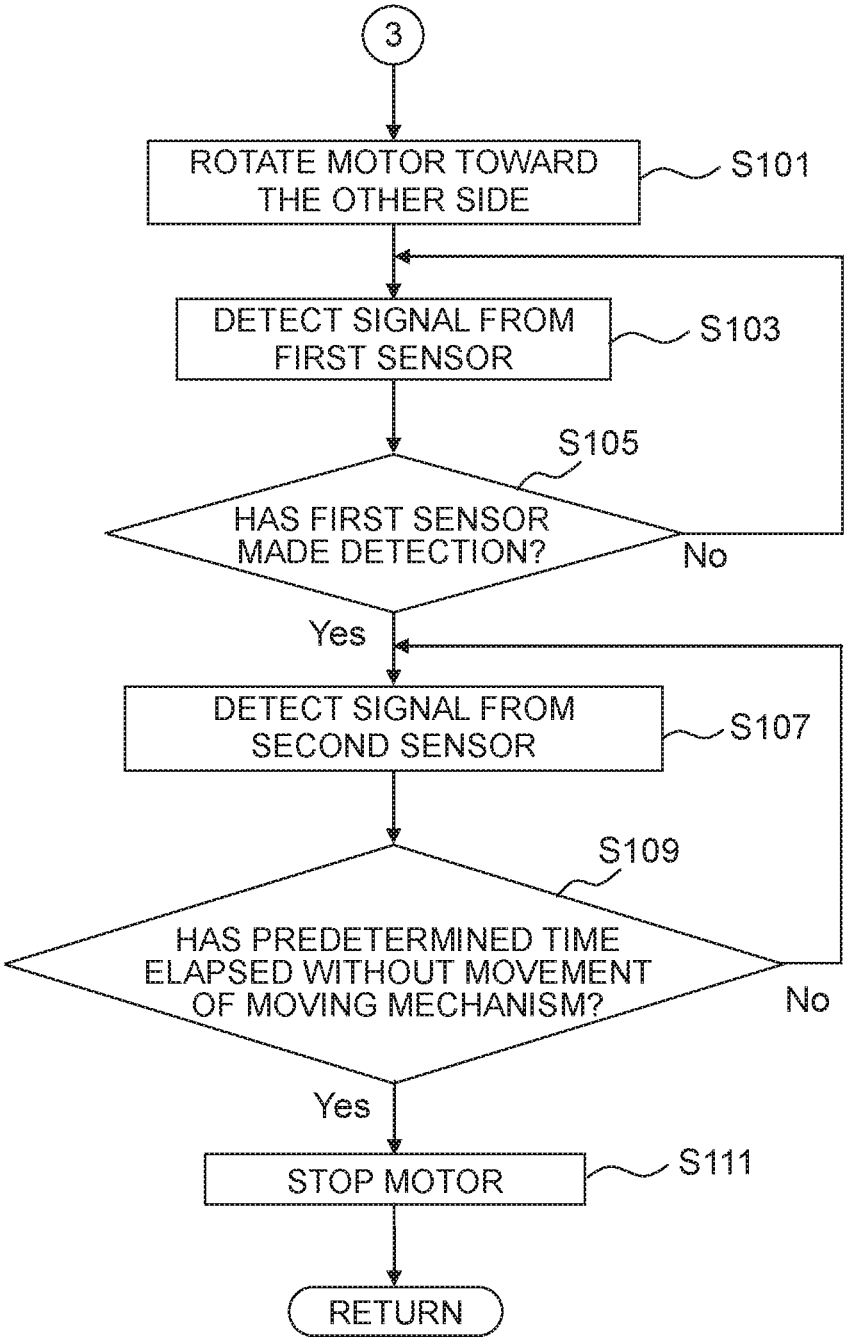

FIG. 16 is a flow chart of the initialization processing, continued from FIG. 15B.

Figure 17A:
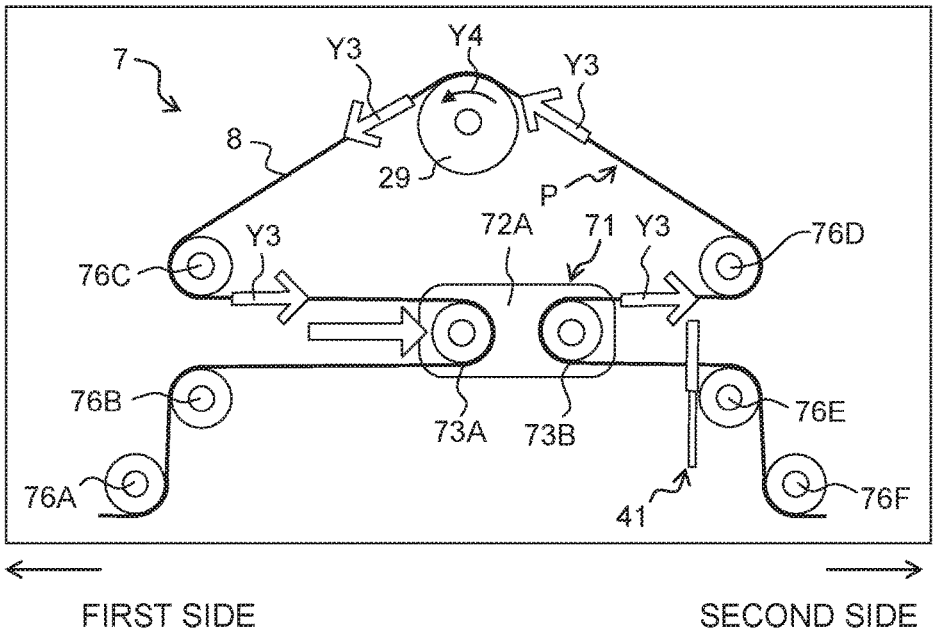
Figure 17B:
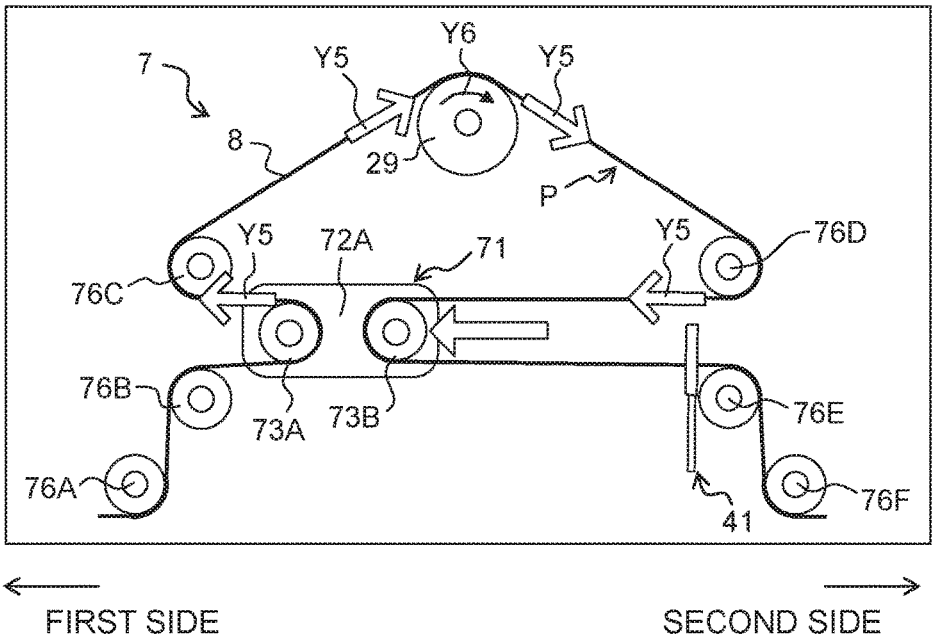

FIGS. 17A and 17B are views for explaining a situation in which the moving mechanism 71 is moved in a state that the conveyance of the print medium 8 by the external apparatus 100 is stopped.

Figure 18:
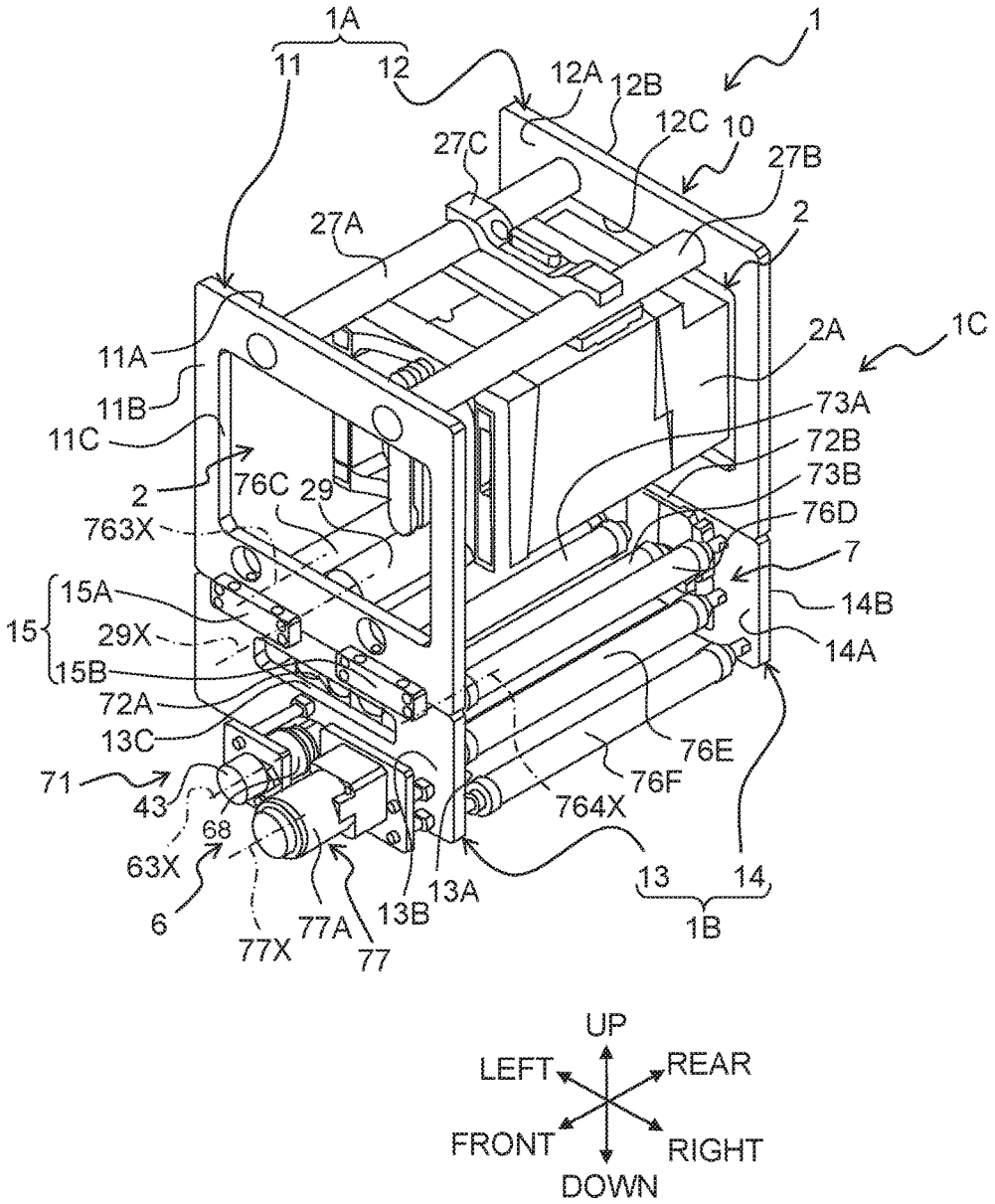

FIG. 18 is a perspective view of a printing apparatus 1 in a modification, as seen from a right obliquely front side thereof.

DESCRIPTION OF THE EMBODIMENTS

For example, in a case of a printing apparatus in which a printing processing is executed by heating with a thermal head, provided that the conveying velocity at which a print medium is conveyed by a conveying device becomes smaller than a predetermined velocity, there is such a possibility that any satisfactory printing quality cannot be maintained. In view of this, while the printing processing is being executed, the printing apparatus normally moves the moving mechanism in a direction in which the print position velocity is accelerating. In this case, after the printing processing is ended, the printing apparatus need to move the moving mechanism in a direction in which the print position velocity is decelerating, and to restore the position of the moving mechanism to its original position.

In view of this situation, a publicly know moving mechanism of the printing apparatus is moved, by the stepping motor, not only in the direction "b" in which the print position velocity is accelerating, but also in the direction "a" in which the print position velocity is decelerating. Accordingly, after the printing processing is ended, it is necessary to drive the stepping motor so as to move the moving mechanism in the direction "a", and to return the moving mechanism to its original position. In this case, there is such a problem that the driving control of the stepping motor, for the purpose of moving the moving mechanism to its original position with a high precision, becomes complex.

An object of the present disclosure is, for example, to provide a printing apparatus, a printing method and a printing program capable of easily executing a control for returning the moving mechanism, which has been moved during the print processing, to its original position.

Figure 2:
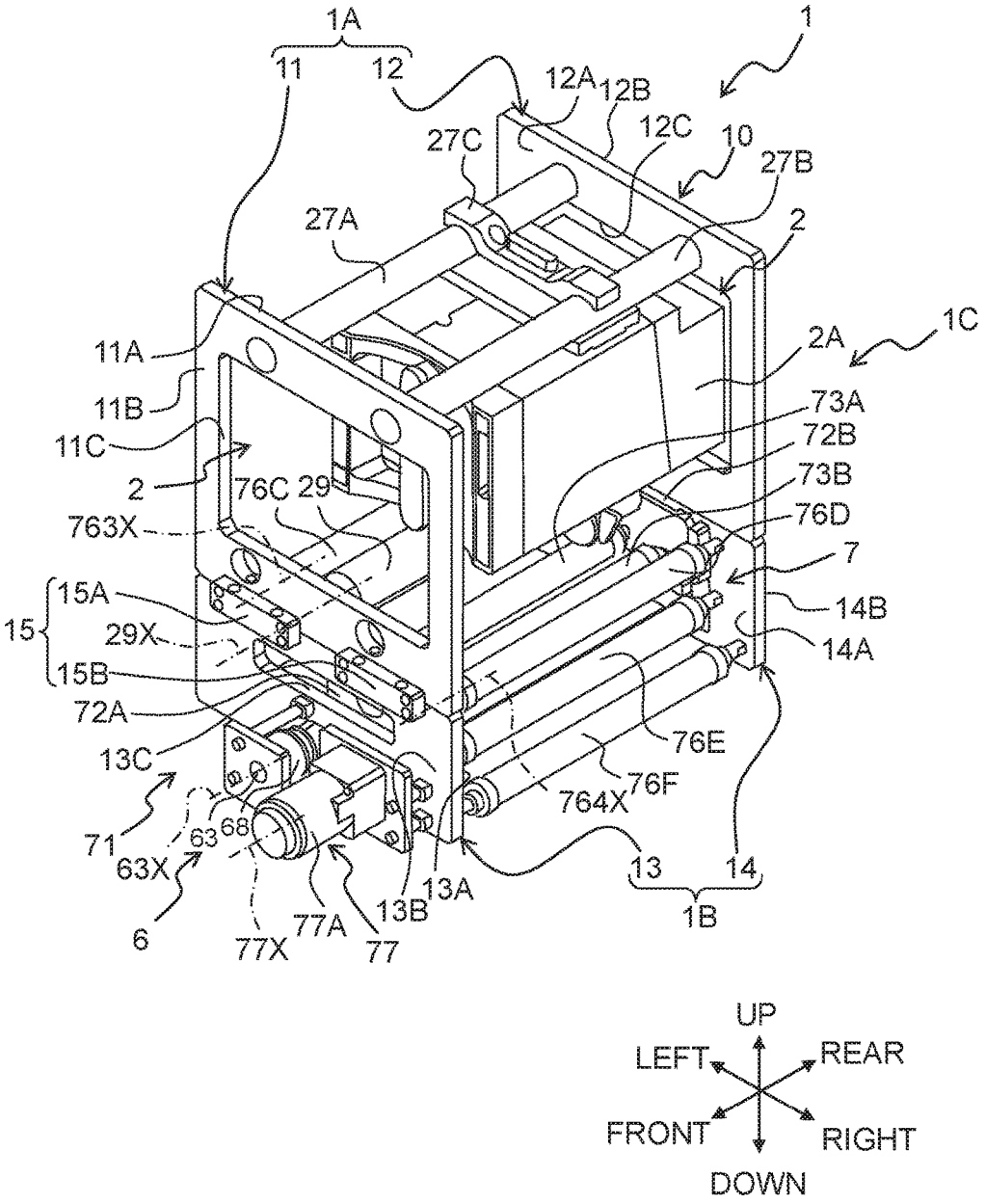
FIG. 2 is a perspective view of the printing apparatus 1 as seen from a right obliquely front side thereof.

An embodiment of the present disclosure will be explained with reference to the drawings. A printing apparatus 1 is a printing apparatus of the thermal transfer type. In the following, the upper side, the lower side, the left side, the right side, the front side and the rear side of the printing apparatus 1 will be defined so that the explanation of the drawings will be easily understood. The upper side, the lower side, the left side, the right side, the front side and the rear side of the printing apparatus 1 correspond to the upper side, the lower side, the left obliquely upper side, the right obliquely lower side, the left obliquely lower side and the right obliquely upper side, respectively, as depicted in FIG. 2.

<General Configuration of Printing Apparatus 1>

Figure 1:
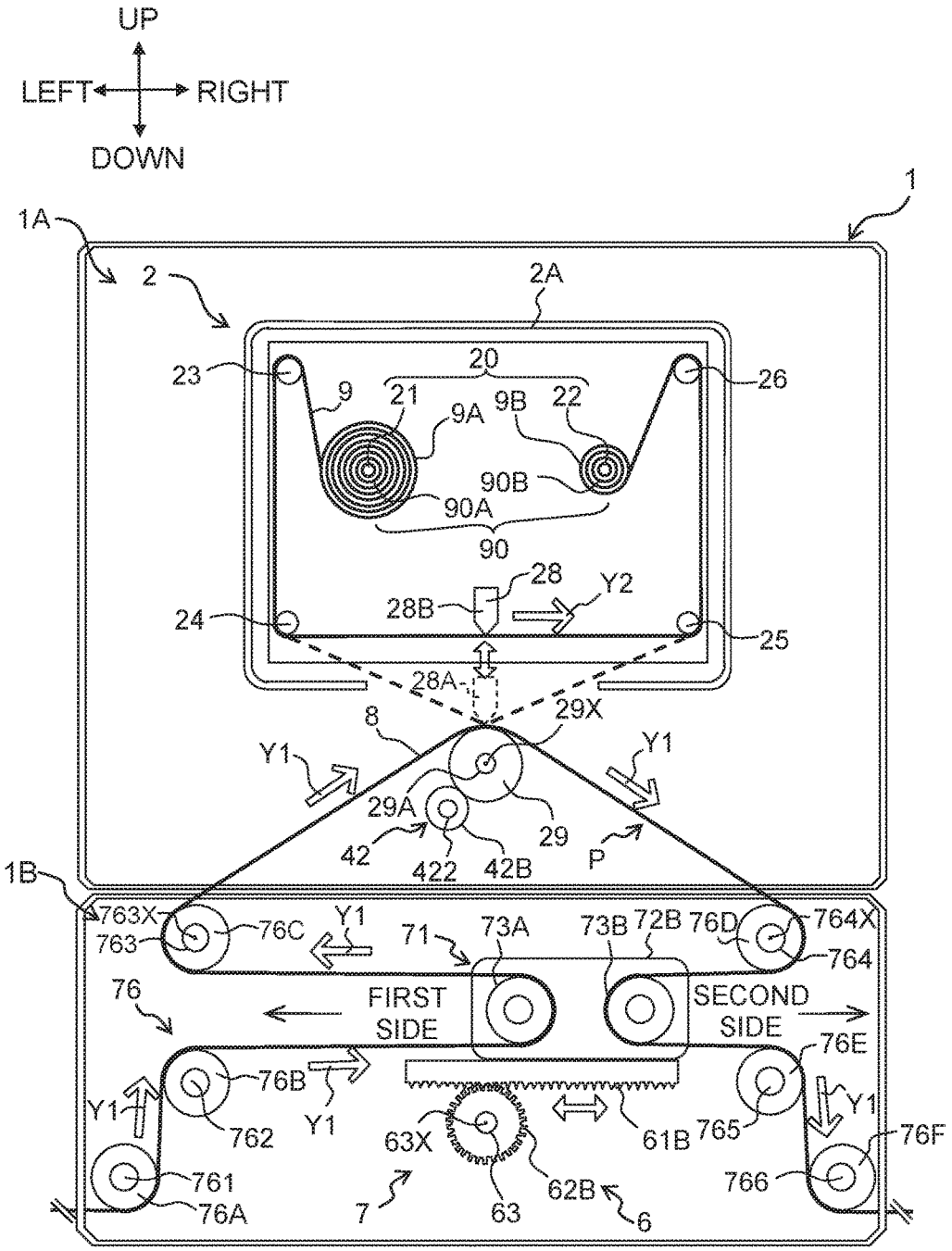
FIG. 1 is a view schematically depicting a printing apparatus 1.

As depicted in FIG. 1, the printing apparatus 1 executes printing with respect to a print medium 8, which is conveyed by an external apparatus 100 (see FIG. 12), by heating an ink ribbon 9. The ink ribbon 9 is accommodated in a ribbon assembly 90 which is detachable/attachable with respect to a printing section 2 (to be described later on). The ink ribbon 9 in the ribbon assembly 90 is wound in a roll shape around each of a core shaft 90A which is connected to one end of the ink ribbon 90 and a core shaft 90B which is connected to the other end of the ink ribbon 90. The ink ribbon 9 wound in the roll shaped around each of the core shaft 90A and the core shaft 90B is referred to as "rolls 9A, 9B". The print medium 8 is conveyed by the external apparatus 100 at a predetermined conveying velocity (hereinafter referred to as a "conveyance position velocity"), and is supplied to a conveying section 7 (to be described later on). A specific example of the external apparatus 100 includes, for example, a packaging machine which conveys a packaging material. In this case, for example, the printing apparatus 1 is incorporated to a part of a conveyance line in which the print medium 8 is conveyed by the packaging machine.

The printing apparatus 1 has a printing section 2 and a conveying section 7. The printing section 2 is arranged on the upper side with respect to (at a position above) the conveying section 7. The printing section 2 controls a printing function with respect to the print medium 8. More specifically, the printing section 2 presses the ink ribbon 9 against the print medium 8 by a thermal head 28 and a platen roller 29, while conveying the ink ribbon 9 in the ribbon assembly 90. The printing section 2 transfers an ink of the ink ribbon 9, which is being conveyed, to the print medium 8 by heating the thermal head 28 in this state. The conveying section 7 controls a function of controlling the conveying velocity, of the print medium 8, which is being conveyed by the external apparatus 100, at a position of the platen roller 29 (also referred to as a "print position velocity"). More specifically, the conveying section 7 moves a moving mechanism 71 arranged in a conveyance path of the print medium 8 (referred to as a "medium path P") to thereby adjust a length of an upstream part or portion, of the medium path P, on the upstream side of the platen roller 29 in the medium path P, and a length of an downstream part or portion, of the medium path P, on the downstream side of the platen roller 29 in the medium path P. By doing so, the conveying section 7 changes the print position velocity with respect to the conveyance position velocity.

<Frame 10>

Figure 3:
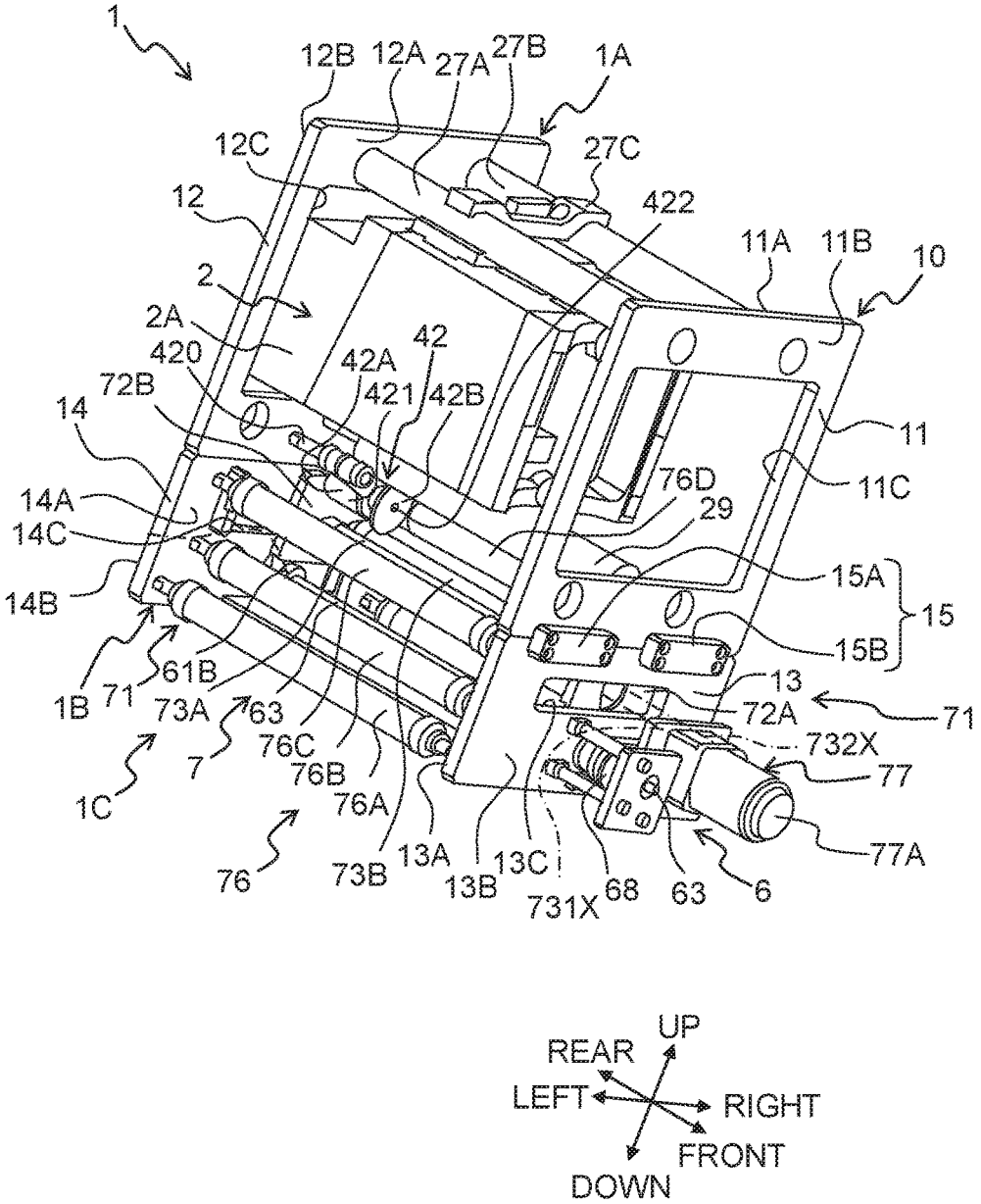
FIG. 3 is a perspective view of the printing apparatus 1 as seen from a left obliquely front side thereof.

As depicted in FIGS. 2 and 3, the printing apparatus 1 has a frame 10. The frame 10 has an upper frame 1A and a lower frame 1B. The upper frame 1A has a first side wall 11 and a second side wall 12. The lower frame 1B has a first side wall 13 and a second side wall 14. The first side walls 11, 13 and the second side walls 12, 14 each have a substantially rectangular-plate shape. Each surface of one of the first side walls 11, 13 and the second side walls 12, 14 is orthogonal to a front-rear direction. The first side wall 11 and the second side wall 12 have an identical shape. The first side wall 11 and the second side wall 12 face each other while being separated in the front-rear direction. The first side wall 11 is arranged on the front side with respect to the second side wall 12. The printing section 2 is arranged between the first side wall 11 and the second side wall 12. The first side wall 13 and the second side wall 14 have an identical shape. The first side wall 13 and the second side wall 14 face each other while being separated in the front-rear direction. The first side wall 13 is arranged on the front side with respect to the second side wall 14. The conveying section 7 is arranged between the first side wall 13 and the second side wall 14. The first side wall 13 is arranged on the lower side with respect to the first side wall 11, and the second side wall 14 is arranged on the lower side with respect to the second side wall 12. Namely, the lower frame 1B is arranged on the lower side (at a position below) the upper frame 1A. The conveying section 7 arranged in the inside of the lower frame 1B is arranged on the lower side (at a position below) the printing section 2 arranged in the inside of the upper frame 1A.

Surfaces of the first side walls 11, 13 oriented to face toward the second side walls 12, 14, respectively, are referred to as first facing surfaces 11A, 13A, respectively. A surface of the first side wall 11 on the opposite side to the first facing surface 11A is referred to as a first opposite surface 11B. A surface of the first side wall 13 on the opposite side to the first facing surface 13A is referred to as a first opposite surface 13B. Surfaces of the second side walls 12, 14 oriented to face toward the first side walls 11, 13, respectively, are referred to as second facing surfaces 12A, 14A, respectively. A surface of the second side wall 12 on the opposite side to the second facing surface 12A is referred to as a second opposite surface 12B. A surface of the second side wall 14 on the opposite side to the second facing surface 14A is referred to as a second opposite surface 14B.

An opening 11C penetrating the first facing surface 11A and the first opposite surface 11B therethrough in the front-rear direction is formed in the first side wall 11. An opening 12C penetrating the second facing surface 12A and the second opposite surface 12B therethrough in the front-rear direction is formed in the second side wall 12. Each of the openings 11C and 12C is rectangular-shaped. A guide groove 13C penetrating the first facing surface 13A and the first opposite surface 13B therethrough in the front-rear direction is formed in the first side wall 13. A guide groove 14C (see FIG. 3) penetrating the second facing surface 14A and the second opposite surface 14B therethrough in the front-rear direction is formed in the second side wall 14. Each of the guide grooves 13C and 14C is a long hole elongated (extending) in the left-right direction.

The first side walls 11, 13 are connected to each other with attaching members 15A, 15B and non-illustrated screws. The second side walls 12, 14 are connected to each other with attaching members 15C, 15D (see FIG. 4) and non-illustrated screws. The attaching members 15A to 15D are collectively referred to as an "attaching member 15". Namely, the upper frame 1A and the lower frame 1B are connected to each other by the attaching member 15. The printing section 2 arranged in the inside of the upper frame 1A and the conveying section 7 arranged in the inside of the lower frame 1B can be separated from each other by removing (detaching) the attaching member 15 and the non-illustrated screws.

<Printing Section 2>

As depicted in FIGS. 1 to 5, the printing section 2 has a casing 2A and the platen roller 29. As depicted in FIGS. 2 to 5, the casing 2A is box-shaped. The casing 2A is arranged at a position below (on the lower side with respect to) columnar-shaped supporting parts 27A, 27B disposed between the first side wall 11 and the second side wall 12. A connecting part 27C arranged on the upper surface of the casing 2A is connected to the supporting parts 27A and 27B.

Figure 5:
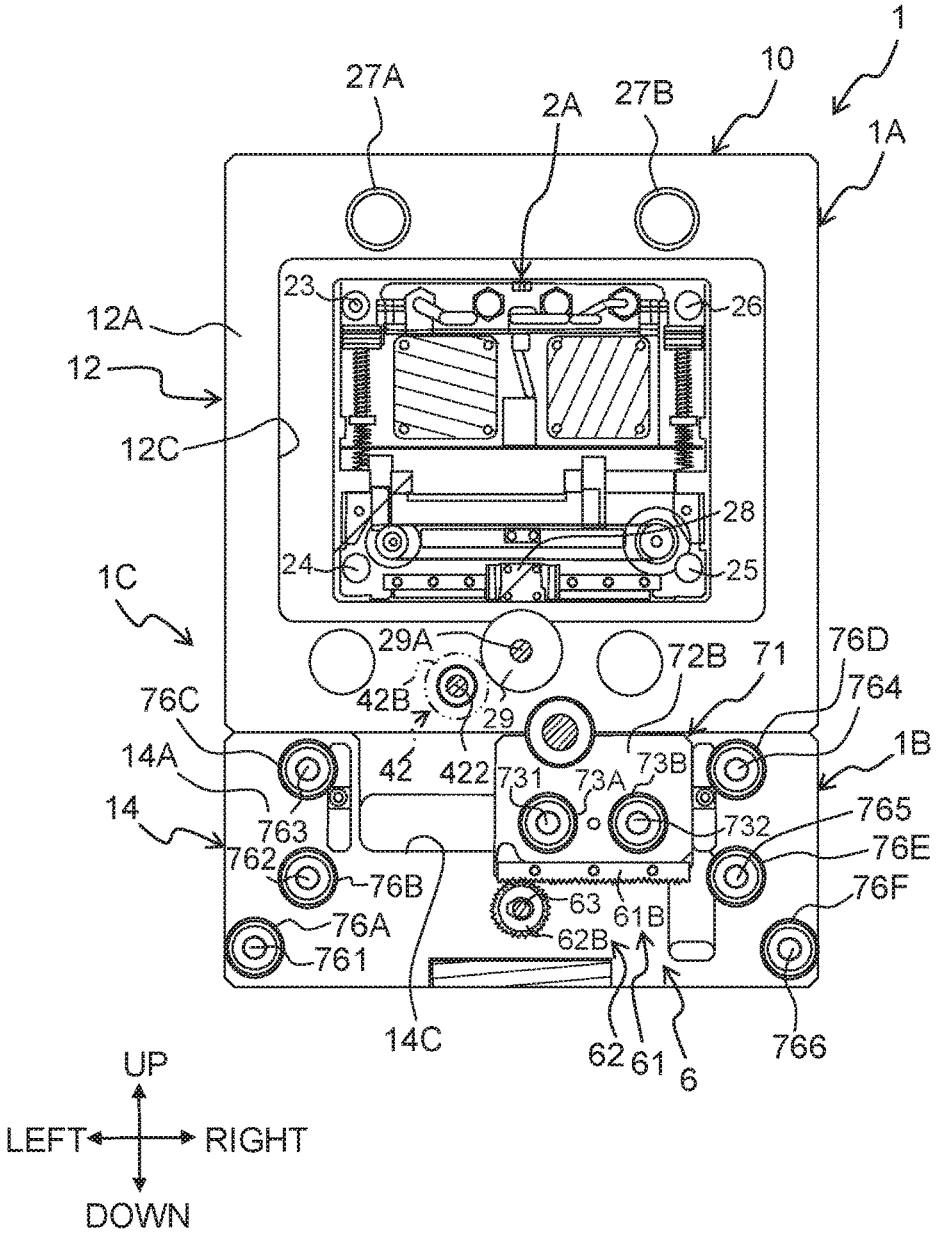
FIG. 5 is a cross-sectional view wherein a line V-V of FIG. 4 is seen from a direction of arrows in FIG. 4.

As depicted in FIGS. 1 and 5, a ribbon installing part 20 (see FIG. 1), guide shafts 23 to 26, and the thermal head 28 are disposed in the inside of the casing 2A. Further, a controller 31, a storing section 32, a driving circuit 37, motors 33 to 35, a communication interface (I/F) 38 and a connection I/F 39 (to be described later on; see FIG. 12) are disposed in the inside of the casing 2A. An operating section 36 (see FIG. 12) is disposed on a surface of the casing 2A.

As depicted in FIG. 1, the ribbon installing part 20 has shafts 21 and 22. Each of the shafts 21 and 22 is a spindle rotatable about a rotation axis extending in the front-rear direction. The roll 9A of the ribbon assembly 90 is installed in the shaft 21. The roll 9B of the ribbon assembly 90 is installed in the shaft 22. The shafts 21 and 22 are directly connected to the shafts of the motors 33 and 34, respectively (see FIG. 12), and are rotatable in accordance with the rotations of the motors 33 and 34, respectively. In a case that the shafts 21 and 22 are rotated in a clockwise direction (clockwise) as seen from the front side, the ink ribbon 9 is let out from the roll 9A, and is wound by the roll 9B. In accordance with the rotations of the shafts 21 and 22, the ink ribbon 9 stretched between the rolls 9A and 9B is conveyed in the inside of the casing 2A. In the following, unless otherwise specifically limited, the rotating direction (clockwise or counterclockwise direction) will be explained with a case of seeing the printing apparatus 1 from the front side, as a premise.

As depicted in FIGS. 1 and 5, the guide shafts 23 to 26 are each a columnar-shaped roller, and is rotatable about a rotation axis extending in the front-rear direction. As depicted in FIG. 1, the ink ribbon 9 stretched between the rolls 9A and 9B makes contact with a part or portion of the circumferential surface of each of the guide shafts 23 to 26, as depicted in FIG. 1. The ink ribbon 9 is guided from the roll 9A toward the roll 9B, while making contact with the guide shafts 23, 24, 25 and 26 in this order. The thermal head 28 makes contact with a part or portion, of the ink ribbon 9, which is located between two positions at which the ink ribbon 9 makes contact with the guide shafts 24 and 25. The thermal head 28 is held to be movable in an up-down direction between a print position 28A and a print stand-by position 28B. The print position 28A is a position at which a lower end part of the thermal head 28 makes contact with the platen roller 29 (to be described later on). The print stand-by position 28B is a position at which the lower end part of the thermal head 28 is separated away from the platen roller 29 toward the upper side with respect to the platen roller 29. The motor 35 (see FIG. 12) moves the thermal head 28 in the up-down direction. In a case that the shafts 21 and 22 are rotated clockwise, the ink ribbon 9 is moved toward the right side (an arrow Y2) at a position at which the ink ribbon 9 makes contact with the thermal head 28.

As depicted in FIGS. 2 to 6, the platen roller 29 is located at a position below (on the lower side with respect to) the casing 2A. The platen roller 29 has a columnar shape. A shaft 29A (see FIGS. 1, 4, 5 and 6), extending along a second rotation axis 29X (see FIGS. 1, 2 and 4), which is parallel to the front-rear direction, is inserted into and through the center of the platen roller 29. A front end part of the shaft 29A is supported by the first side wall 11 and a rear end part of the shaft 29A is supported by the second side wall 12. The platen roller 29 is rotatable, with respect to the shaft 29A, about the second rotation axis 29X as the center of the rotation. As depicted in FIGS. 1 and 5, the platen roller 29 faces (is opposite to) a lower part or portion of the thermal head 28 which is in the inside of the casing 2A. In response to (in accordance with) movement of the thermal head 28 from the print stand-by position 28B to the print position 28A (see FIG. 1), the platen roller 29 presses the ink ribbon 9 and the print medium 8 (see FIG. 1) against the thermal head 28.

In the following, a part or portion which is different from the casing 2A and the platen roller 29 in the printing apparatus 1 is referred to as a bracket 1C.

<Conveying Section 7>

Figure 4:
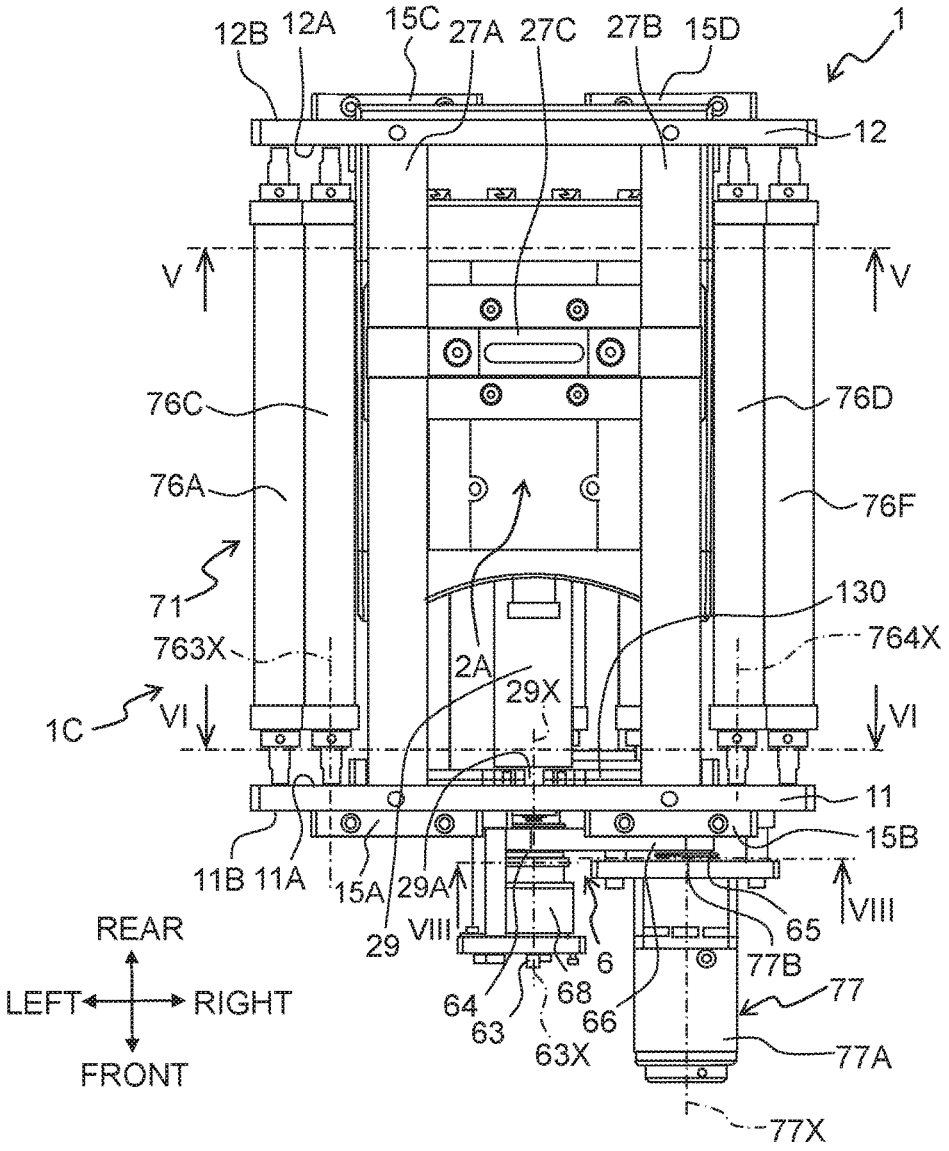
FIG. 4 is a plane view of the printing apparatus 1 as seen from an upper side thereof.

As depicted in FIGS. 1 to 7, the conveying section 7 has the moving mechanism 71 (see FIGS. 1 to 3 and 5 to 7), guide rollers 76A to 76F (collectively referred to as a "guide roller 76") (see FIGS. 1 and 5), a motor 77 (see FIGS. 2 to 4), a transmitting mechanism 6 (see FIGS. 1 to 6), and a clutch 68 (see FIGS. 2 to 4). Further, the conveying section 7 is provided with a driving circuit 40, a first sensor 41, a second sensor 42 and a connection I/F 44 (to be described later on) (see FIG. 12).

<Moving Mechanism 71>

The moving mechanism 71 has a first supporting member 72A (see FIGS. 2, 3 and 6), a second supporting member 72B (see FIGS. 2, 3, 5 and 7) (collectively referred to as a "supporting member 72"); a first roller 73A, a second roller 73B (see FIGS. 2, 3 and 5), a guide rail 130 (see FIG. 6) and the guide groove 14C (which has been already described).

Figure 6:
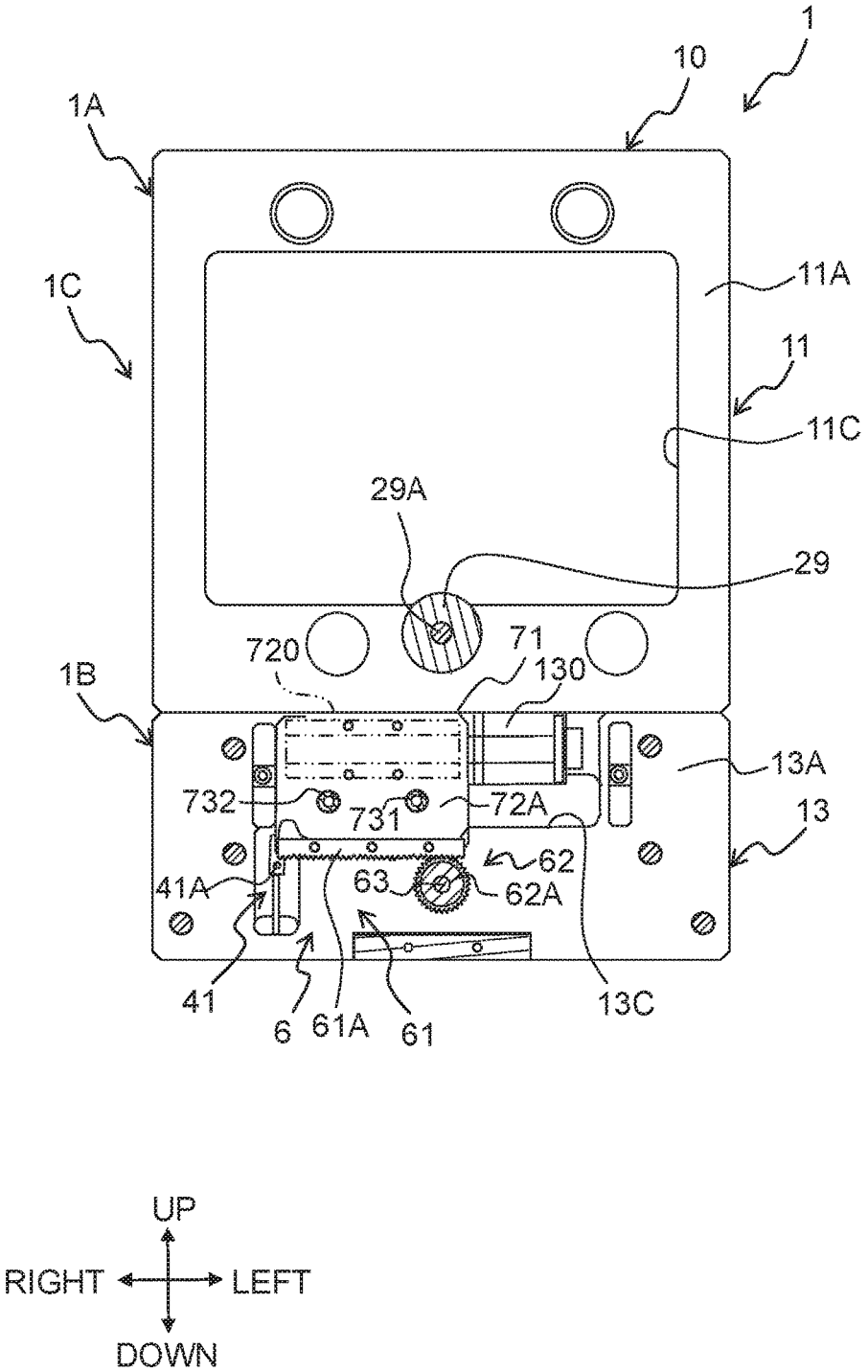
FIG. 6 is a cross-sectional view wherein a line VI-VI of FIG. 4 is seen from a direction of arrows in FIG. 4.

As depicted in FIG. 6, the guide rail 130 is connected to a part or portion, of the first facing surface 13A of the first side wall 13, which is located on the upper side with respect to (located above) the guide groove 13C. The guide rail 130 projects rearwardly from the first facing surface 13A. The guide rail 130 linearly extends in the left-right direction along an upper part or portion of the guide groove 13C.

As depicted in FIGS. 2, 3, 5 and 6, the supporting member 72 has a rectangular plate-shape. The supporting member 72 supports a first roller 73A and a second roller 73B (to be described later on). As depicted in FIG. 6, the first supporting member 72A is arranged closely, from the rear side, to a part or portion, of the first facing surface 13A of the first side wall 13, in which the guide rail 130 and the guide groove 13C are provided. A stage 720, engageable with the guide rail 130 disposed in the first facing surface 13A, is disposed on the front surface (the far side of the sheet surface of FIG. 6) of the first supporting member 72A. The stage 720 has two projections projecting frontwardly. The two projections are separated away from each other in the up-down direction, and sandwich the guide rail 130 therebetween in the up-down direction. The spacing distance between the two projections of the stage 720 is slightly greater than the length in the up-down direction of the guide rail 130. The stage 720 is engaged with the guide rail 130 to be movable in the left-right direction which is the extending direction of the guide rail 130. As the guide rail 130 and the stage 720, a commercially available linear guide can be used.

Figure 7:
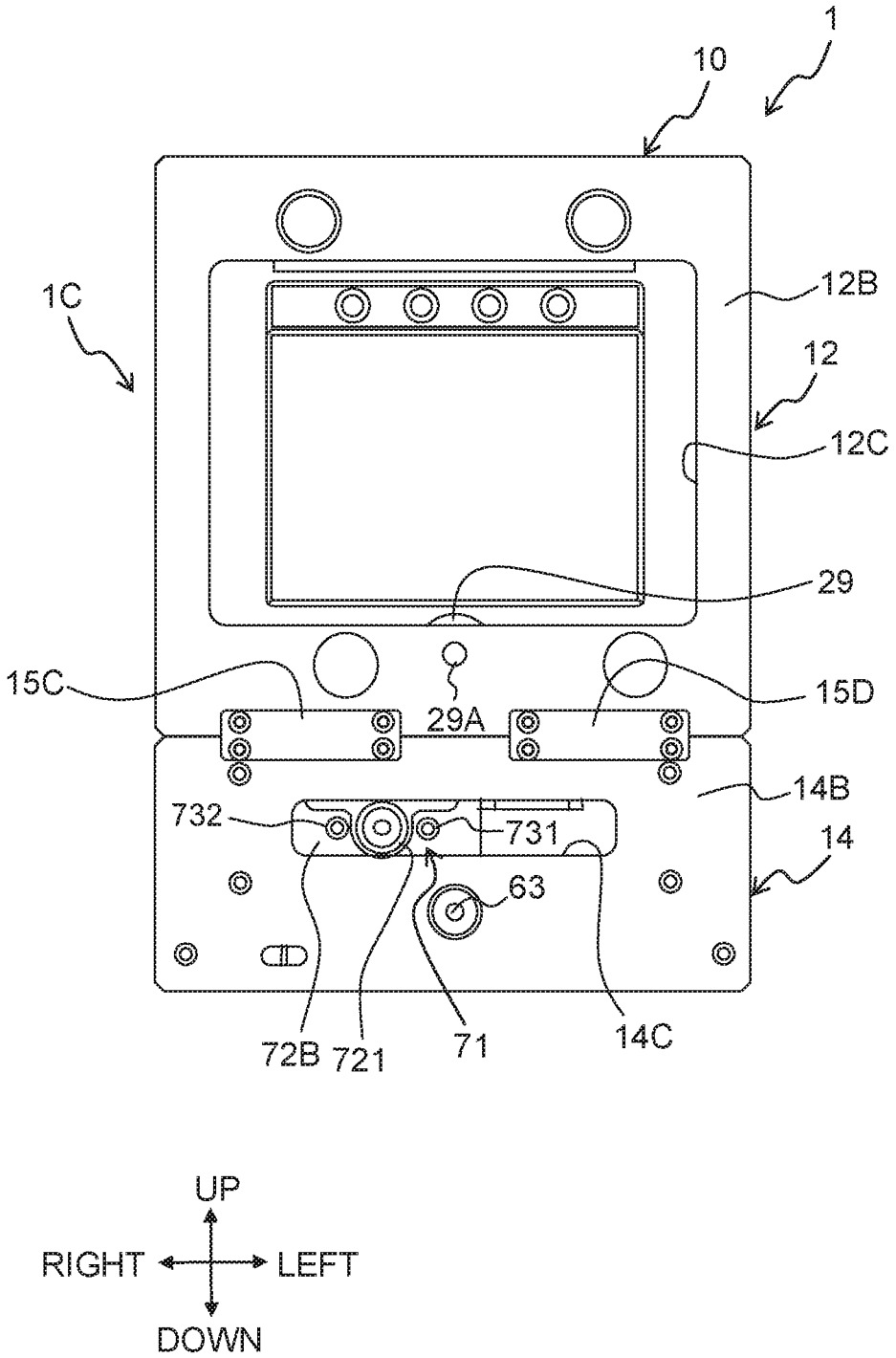
FIG. 7 is a rear view of the printing apparatus 1 as seen from a rear (back) side thereof.

As depicted in FIG. 5, the second supporting member 72B is arranged closely, from the front side, to a certain part or portion, of the second facing surface 14A of the second side wall 14, in which the guide groove 14C is provided and to another part or portion, of the second facing surface 14A, located above the certain part or portion. As depicted in FIG. 7, a projection 721 engageable with the guide groove 14C is provided on a rear surface (the front side in the sheet surface of FIG. 7) of the second supporting member 72B. The shape of the projection 721 is columnar. The center of the projection 721 extends in the front-rear direction. The diameter of the projection 721 is slightly smaller than the spacing distance in the up-down direction of the guide groove 14C. The projection 721 is engaged with the guide groove 14C to be movable in the left-right direction which is the extending direction of the guide groove 14C. The projection 721 is, for example, a roller rotatably supported by the second supporting member 72B.

As depicted in FIGS. 2 and 3, the first roller 73A and the second roller 73B are held between the first supporting member 72A and the second supporting member 72B in the front-rear direction. The first roller 73A and the second roller 73B are arranged side by side in the left-right direction. The first roller 73A is arranged on the left side with respect to the second roller 73B. The first roller 73A and the second roller 73B are moved in the left-right direction integrally with the supporting member 72, in accordance with the movement of the supporting member 72. Namely, the moving mechanism 71 (the supporting member 72, first roller 73A, second roller 73B) is supported to be movable in the left-right direction with respect to the lower frame 1B. Note that in a case that the printing apparatus 1 is used while being placed on a horizontal plane, the left-right direction is parallel to the horizontal direction.

As depicted in FIG. 5, a columnar-shaped shaft 731 extending in the front-rear direction is inserted into and through the first roller 73A. A columnar-shaped shaft 732 extending in the front-rear direction is inserted into and through the second roller 73B. As depicted in FIG. 6, each of front end parts of the shafts 731 and 732 is supported by the first supporting member 72A. As depicted in FIG. 7, each of rear end parts of the shafts 731 and 732 is supported by the second supporting member 72B. The first roller 73A and the second roller 73B are rotatable with respect to the shafts 731 and 732, respectively. As depicted in FIG. 3, a rotation axis 731X of the first roller 73A and a rotation axis 732X of the second roller 73B extend in the front-rear direction while passing through the centers of the shafts 731 and 732, respectively.

<Motor 77, Transmitting Mechanism 6, Clutch 68>

As depicted in FIGS. 2 to 4, the motor 77 is supported by the first opposite surface 13B of the first side wall 13 of the lower frame 1B. A columnar-shaped body part 77A of the motor 77 projects frontwardly with respect to the first opposite surface 13B. As depicted in FIG. 4, a shaft 77B of the motor 77 extends rearwardly from the body part 77A. A forward end part of the shaft 77B is arranged in front of the first opposite surface 13B of the first side wall 13. The shaft 77B is rotated about a fifth rotation axis 77X extending in the front-rear direction, in accordance with the driving of the motor 77.

As depicted in FIGS. 4 to 8, the transmitting mechanism 6 transmits the driving force of the motor 77 to the moving mechanism 71, and moves the moving mechanism 71 in the left-right direction. The transmitting mechanism 6 has a first rack gear 61A (see FIG. 6), a second rack gear 61B (see FIG. 5) (collectively referred to as a "rack gear 61"); a first pinion gear 62A (see FIG. 6), a second pinion gear 62B (see FIG. 5) (collectively referred to as a "pinion gear 62"); a driving shaft 63; a first pulley 64 (see FIG. 8); a second pulley 65 (see FIG. 8); a belt 66 (see FIG. 8); and a bearing 67 (see FIG. 8). The transmitting mechanism 6 is supported by the lower frame 1B.

Figure 8:
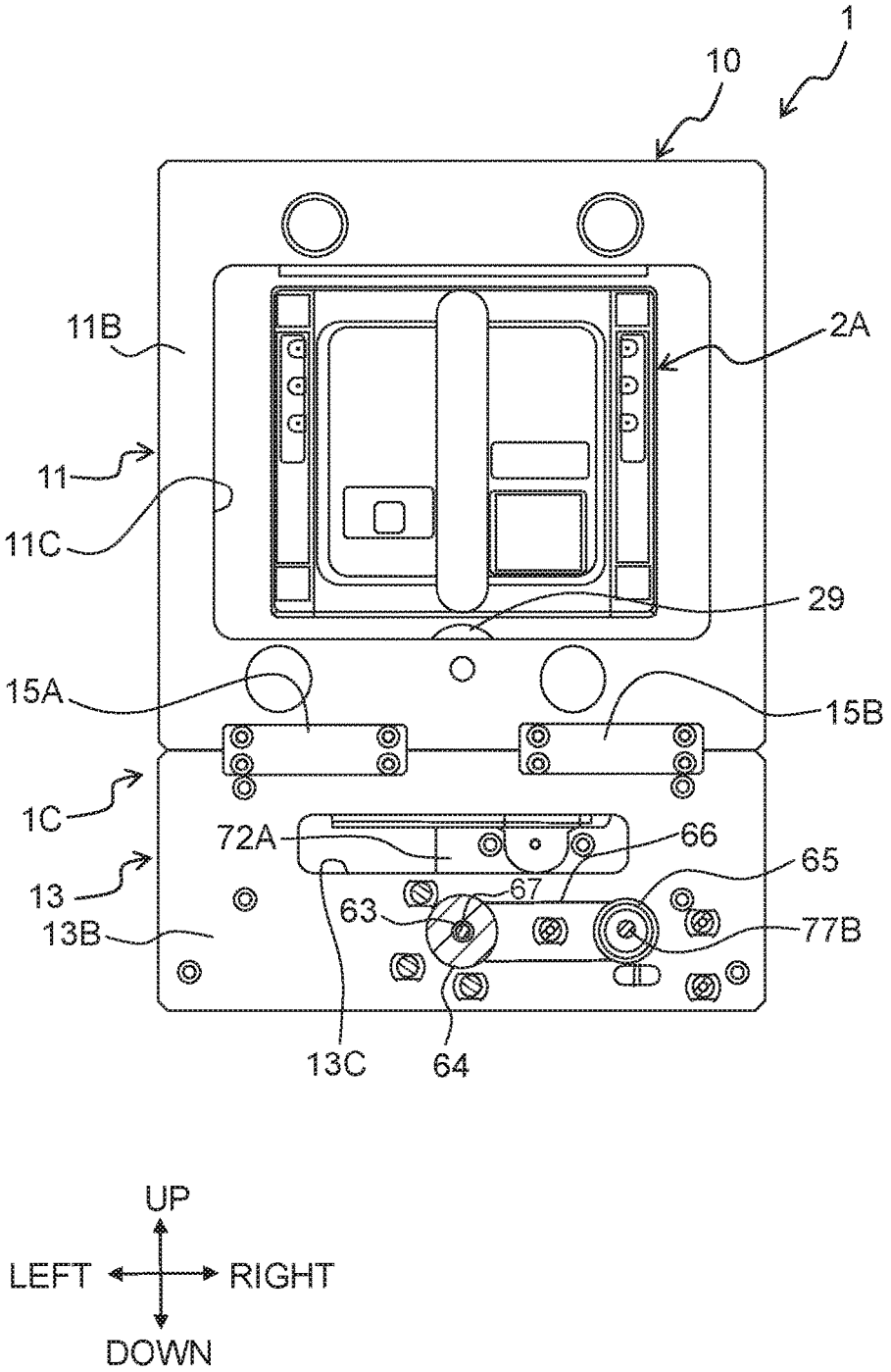
FIG. 8 is a cross-sectional view wherein a line VIII-VIII of FIG. 4 is seen from a direction of arrows in FIG. 4.

As depicted in FIGS. 4 and 8, the second pulley 65 is connected to the shaft 77B of the motor 77. The second pulley 65 is rotated about the fifth rotation axis 77X (see FIG. 4) as the rotation axis of the shaft 77, in accordance with the rotation of the shaft 77B by the driving of the motor 77. The belt 66 is stretched between the first pulley 64 and the second pulley 65 (to be described later on). In a case that the motor 77 is driven, the belt 66 transmits the rotation driving force to the first pulley 64 via the second pulley 65, to thereby rotate the first pulley 64.

As depicted in FIGS. 4 to 8, the driving shaft 63 extends along the front-rear direction at a substantially central part or portion in the left-right direction of the lower frame 1B and at a location below the guide grooves 13C and 14C. As depicted in FIG. 7, a rear end part of the driving shaft 63 is rotatably supported by a part or portion, of the second side wall 14, which is located below the guide groove 14C. As depicted in FIG. 4, a front end part of the driving shaft 63 penetrates through a hole formed in a part or portion, of the first side wall 13C, which is located below the guide groove 13C, and projects frontwardly beyond the first side wall 13. The driving shaft 63 extends in the front-rear direction while passing through a location below the supporting member 72. The driving shaft 63 is rotatable about a first rotation axis 63X extending in the front-rear direction. Note that the first rotation axis 63X is parallel to the fifth rotation axis 77X which is the rotation axis of the shaft 77B of the motor 77.

As depicted in FIGS. 4 and 8, a part or portion, of the driving shaft 63, projecting frontwardly beyond the first side wall 13, in other words, an outer circumferential surface of the part or portion, of the driving shaft 63, located on the front side relative to (in front of) the first opposite surface 13B of the first side wall 13 is provided with the first pulley 64. The rotation axis of the first pulley 64 is coincident with the first rotation axis 63X of the driving shaft 63. Namely, the first pulley 64 is provided coaxially with the driving shaft 63. The first pulley 64 is separated away from the second pulley 65 to be on the left side with respect to the second pulley 65. The belt 66 is stretched between the first pulley 64 and the second pulley 65. The first pulley 64 is rotated about the first rotation axis 63X parallel to the fifth driving axis 77X (see FIG. 4) of the second pulley 65, by the driving force of the motor 77 transmitted to the first pulley 64 from the motor 77 via the belt 66.

As depicted in FIG. 8, a bearing 67 is interposed between the driving shaft 63 and the first pulley 64. The bearing 67 reduces the frictional force between the driving shaft 63 and the first pulley 64. Accordingly, even in a case that the first pulley 64 is rotated by the driving force of the motor 77 transmitted to the first pulley 64 by the belt 66, the driving shaft 63 is not rotated, unless the driving force is transmitted from the first pulley 64 to the driving shaft 63 by the clutch 68 (to be described as follows).

As depicted in FIG. 4, the clutch 68 is provided at a location in front of the first pulley 64. The clutch 68 is an electromagnetic clutch having two elements which are an element to which the driving shaft 63 is connected, and an element to which the first pulley 64 is connected. The clutch 68 is switched between a state in which the two elements are connected and a state in which the two elements are cut off, in accordance with a switching signal output from the driving circuit 40 (see FIG. 12). In the state that the two elements are connected, the driving force of the motor 77 is transmitted between the two elements. In the state that the two elements are cut off, the driving force of the motor 77 is not transmitted between the two elements. In the following, the state in which the two elements are connected in the clutch 68 is referred to as a "connected state", and the state that the two elements are cut off in the clutch 68 is referred to as a "cutoff state". For example, the clutch 68 may be an excitation operative electromagnetic clutch which maintains the connected state while a driving current as the switching signal is supplied thereto from the driving circuit 40, and maintains the cutoff state while the driving current is not supplied thereto from the driving circuit 40.

As depicted in FIG. 6, the first pinion gear 62A is connected to a part or portion, of the driving shaft 63, located on the rear side with respect to (located behind) the first facing surface 13A of the first side wall 13. The first pinion gear 62A is rotated in accordance with the rotation of the driving shaft 63. As depicted in FIG. 5, the second pinion gear 62B is connected to a part or portion, of the driving shaft 63, located on the front side with respect to (located in front of) the second facing surface 14A of the second side wall 14. The second pinion gear 62B is rotated in accordance with the rotation of the driving shaft 63.

As depicted in FIG. 6, the first rack gear 61A is provided on a lower end part of the first supporting member 72A. The length in the left-right direction of the first rack gear 61A is substantially same as the length in the left-right direction of the first supporting member 72A. The first rack gear 61A has teeth in a lower part or portion thereof. The first pinion gear 62A is arranged at a location below (on the lower side with respect to) the first rack gear 61A. The teeth of the first pinion gear 62A mesh with the teeth of the first rack gear 61A from therebelow. As depicted in FIG. 5, the second rack gear 61B is provided on a lower end part of the second supporting member 72B. The length in the left-right direction of the second rack gear 61B is substantially same as the length in the left-right direction of the second supporting member 72B. Note that the lower end part of the supporting member 72 is located at a position below (on the lower side with respect to) each of the lowermost end parts of the outer circumferential surfaces of the first roller 73A and the second roller 73B. Accordingly, the rack gear 61 (the first rack gear 61A and second rack gear 61B) is located at the position below (on the lower side with respect to) the lowermost end part or portion of the outer circumferential surface of each of the first roller 73A and the second roller 73B. The second rack gear 61B has teeth in a lower part or portion thereof. The second pinion gear 62B is arranged at a location below (on the lower side with respect to) the second rack gear 61B. The teeth of the second pinion gear 62B mesh with the teeth of the second rack gear 61B from therebelow. The rack gear 61 extends in the left-right direction.

In a case that the clutch 68 is in the connected state and that the shaft 77B is rotated in accordance with the driving of the motor 77, the driving force of the motor 77 is transmitted to the driving shaft 63 via the second pulley 65, the belt 66, the first pulley 64 and the clutch 68. The pinion gear 62 connected to the driving shaft 63 moves the rack gear 61 in the left-right direction in accordance with the rotation of the driving shaft 63. With this, the moving mechanism 71 is moved in the left-right direction. In a case that the shaft 77B of the motor 77 is rotated in the counterclockwise direction, the moving mechanism 71 moves leftwardly. In a case that the shaft 77B of the motor is rotated in the clockwise direction, the moving mechanism 71 moves rightwardly.

As depicted in FIG. 1, in a movable direction (left-right direction) in which the moving mechanism 71 is movable, the left side (leftward) is referred to as a "first side", and the right side (rightward) is referred to as a "second side". The rotating direction (counterclockwise direction) of the shaft 77B of the motor 77 in a case that the moving mechanism 71 is caused to move toward the first side is referred to as "toward one direction". The rotating direction (clockwise direction) of the shaft 77B of the motor 77 in a case that the moving mechanism 71 is caused to move toward the second side is referred to as "toward the other direction".

Figure 9A:
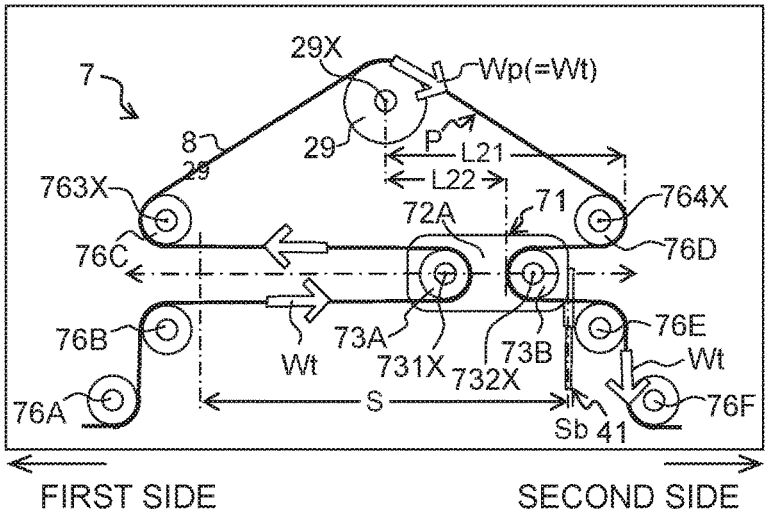
FIGS. 9A to 9C are views for explaining an operation of a moving mechanism 71.

As depicted in FIG. 9A, a range in which the first supporting member 72A is movable in the left-right direction is referred to as a "moving range S". The moving range S corresponds to a range from an end part, on the first side, of the first supporting member 72A which is moved most closely to the first side to an end part, on the second side, of the first supporting member 72A which is moved most closely to the second side. A position of the end part on the second side of the first supporting member 72A which is moved most closely to the second side is referred to as a "reference position Sb". The reference position Sb corresponds to a position separated farthest toward the second side from the end part on the first side of the moving range S. A state or situation in which the end part on the second side of the first supporting member 72A is located at the reference position Sb is referred to as "the moving mechanism 71 is arranged at the reference position Sb". FIGS. 5 to 8 depict a state of the moving mechanism 71 arranged at the reference position Sb. A position of the center in the left-right direction of the moving range S is coincident with the position of the second rotation axis 29X of the platen roller 29.

<First Sensor 41>

As depicted in FIG. 6, a first sensor 41 is provided on a part or portion, of the first facing surface 13A of the first side wall 13, located on the lower side (located below) a right end part of the guide groove 13C. The first sensor 41 is a proximity sensor of the non-contact type. The proximity sensor is appropriately selected among those of photoelectric type, eddy current type (electromagnetic induction type), ultrasonic wave type, etc., depending on the material of the first supporting member 72A. The first sensor 41 has a detector 41A extending upwardly. The position in the left-right direction of the detector 41A is substantially same as the position of the end part on the second side of the first supporting member 72A in the case that the moving mechanism 71 is arranged at the reference position Sb, namely, is substantially same as the reference position Sb (see FIGS. 9A to 9C). The detector 41A detects proximity or contact of the first supporting member 72A in a range corresponding to a predetermined length in the left-right direction (referred also as a "detecting range"). In the following, a case that the detector 41A detects the proximity or contact of the first supporting member 72A is simply referred to as "the detector 41A detects the first supporting member 72A". The first sensor 41 is capable of outputting a signal indicating the presence or absence of the detection of the first supporting member 72A by the detector 41A. Note that it is also allowable that a limit switch is used as the first sensor 41, rather than using the proximity sensor.

Note that in order to detect, by the first sensor 41, the position of the end part on the second side of the first supporting member 72*a*, in the case that the moving mechanism 71 is arranged at the reference position Sb, it is preferred that a boundary position on the first side of the detecting range of the detector 41A is coincident with the reference position Sb. There is such a possibility, however, that the boundary position on the first side of the detecting range of the first sensor 41A might be fluctuated or varied with respect to the reference position Sb, due to any assembly error of the first sensor 41, any individual difference in the first sensor 41, any noise, etc. In view of this, the position in the left-right direction at which the first sensor 41 is arranged is adjusted such that the reference position Sb is included in the detecting range even in a case that any fluctuation (variation) is occurred. As a result, there is such a case that the boundary position on the first side of the detecting range of the detector 41A is arranged at any position between the reference position Sb and a position which is separated away from the reference position Sb toward the first side by a predetermined length. Namely, in a case that the end part on the second side of the first supporting member 72A is located within a range (detecting range) up to the position which is separated away from the reference position Sb toward the first side by the predetermined length, the first sensor 41 detects the end part on the second side of the first supporting member 72A by the detector 41A.

<Second Sensor 42>

As depicted in FIG. 3, a second sensor 42 is provided on a location below the platen roller 29. The second sensor 42 has a rotary encoder 42A and a rotating plate 42B. The rotary encoder 42A is accommodated in the inside of a columnar-shaped body 421. The body 421 is fixed to the second side wall 12 by a stick-shaped attaching part 420 which extends frontwardly from the second facing surface 12A of the second side wall 12. A shaft 422 of the rotary encoder 42A extends frontwardly from the body 421, parallel to the second rotation axis 29X (see FIG. 2) of the platen roller 29. The disc-shaped rotating plate 42B is connected to the shaft 422. As depicted in FIG. 1, a circumferential end part of the rotating plate 42B makes contact with a left obliquely lower part of the circumferential surface of the platen roller 29. The rotating plate 42B and the shaft 422 are rotated in accordance with the rotation of the platen roller 29. The rotary encoder 42A detects a rotation amount of the shaft 422, and outputs a signal in accordance with the rotation amount. More specifically, the rotary encoder 42A alternately outputs a Hi signal and a Low signal every time the shaft 422 is rotates by a predetermined angle.

<Guide Roller 76>

As depicted in FIGS. 1 to 5, the guide rollers 76A to 76F (collectively referred to as a "guide roller 76") are arranged at a position below the platen roller 29 and between the first side wall 13 and the second side wall 14. The guide roller 76 has a columnar shape. Shafts 761 to 766 (see FIGS. 1 and 5)

each of which extends along a rotation axis parallel to the front-rear direction are inserted into the centers of the guide rollers 76A to 76F, respectively. A front end part of each of the shafts 761 to 766 is supported by the first side wall 13, and a rear end part of each of the shafts 761 to 766 is supported by the second side wall 14. The guide roller 76 is rotatable about the rotation axis with respect to any one of the shafts 761 to 766 corresponding thereto.

In the following, the guide roller 76C is referred to as a "third roller 76C" and the guide roller 76D is referred to as a "fourth roller 76D", in some cases. As depicted in FIGS. 2 and 4, among the respective rotation axes, a rotation axis extending in the front-rear direction while passing through the center of the shaft 763 of the third roller 76C is referred to as a "third rotation axis 763X", and a rotation axis extending in the front-rear direction while passing through the center of the shaft 764 of the fourth roller 76D is referred to as a "fourth rotation axis 764X". The first rotation axis 63X, the third rotation axis 763X, the fourth rotation axis 764X, the second rotation axis 29X and the fifth rotation axis 77X each extend in the front-rear direction orthogonal to the left-right direction as the moving direction of the moving mechanism 71. The first rotation axis 63X, the third rotation axis 763X, the fourth rotation axis 764X, the second rotation axis 29X and the fifth rotation axis 77X are parallel to one another.

As depicted in FIG. 1, the guide rollers 76A, 76B and 76C are arranged on the left side with respect to the platen roller 29 in the left-right direction. The positions of the guide rollers 76B and 76C in the left-right direction are substantially same. The guide roller 76A is arranged on the left side with respect to the guide rollers 76B and 76C in the left-right direction. The guide rollers 76D, 76E and 76F are arranged on the right side with respect to the platen roller 29 in the left-right direction. The positions of the guide rollers 76D and 76E in the left-right direction are substantially same. The guide roller 76F is arranged on the right side with respect to the guide rollers 76D and 76E in the left-right direction. The guide rollers 76C and 76D are arranged on the upper side with respect to the moving mechanism 71 in the up-down direction. The positions of the guide rollers 76C and 76D in the up-down direction are substantially same. The guide rollers 76A, 76B, 76E and 76F are arranged on the lower side with respect to the moving mechanism 71 in the up-down direction. The positions of the guide rollers 76A and 76F in the up-down direction are substantially same. The positions of the guide rollers 76B and 76E in the up-down direction are substantially same. The guide roller 76A is arranged on the left obliquely lower side with respect to the guide roller 76B. The guide roller 76F is arranged on the right obliquely lower side with respect to the guide roller 76E.

Figure 9B:
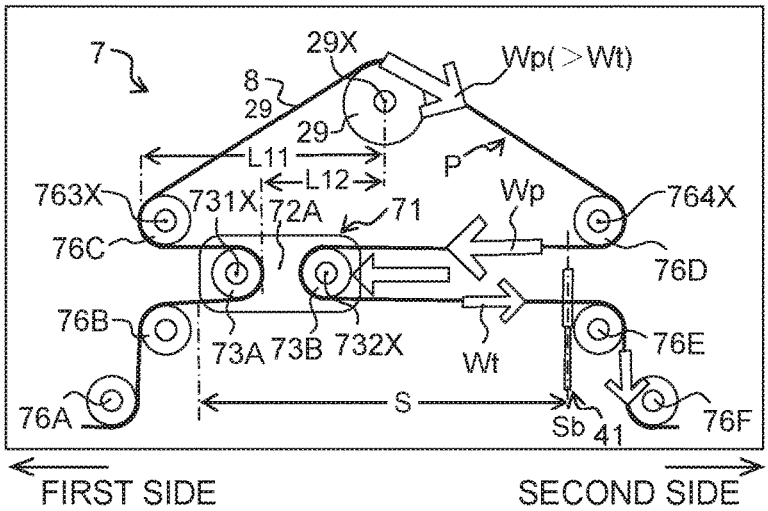

As depicted in FIG. 9A, in a state that the moving mechanism 71 is moved most closely toward the second side, namely in a state that the moving mechanism 71 is arranged at the reference position Sb, the rotation axis 732X of the second roller 73B is arranged on the left side with respect to the shafts 764 and 765 of the guide rollers 76D and 76E, respectively, in the left-right direction. As depicted in FIG. 9B, in a state that the moving mechanism 71 is moved most closely toward the first side, the rotation axis 731X of the first roller 73A is arranged on the right side with respect to the shafts 762 and 763 of the guide rollers 76B and 76C, respectively, in the left-right direction.

As depicted in FIG. 1, the print medium 8 is supplied to the conveying section 7 from the outside of the printing apparatus 1 by the external apparatus 100 (see FIG. 12). The print medium 8 is stretched among the platen roller 29, the first roller 73A and the second roller 73B of the moving mechanism 71, and the guide roller 76, and is conveyed. A path via which the print medium 8 passes while being conveyed along the platen roller 29, the first roller 73A, the second roller 73B and the guide roller 76 corresponds to the medium path P. The medium path P extends while changing the direction as making contact sequentially with each of the guide rollers 76A and 76B, the first roller 73A, the guide roller 76C, the platen roller 29, the guide roller 76D, the second roller 73B, and the guide rollers 76E and 76F. The print medium 8 is conveyed in a direction moving, along the medium path P, from the guide roller 76A toward the guide roller 76F (a direction of arrows Y1). The guide rollers 76A to 76C, and the first roller 73A of the moving mechanism 71 are arranged on the upstream side with respect to the platen roller 29 in the medium path P. The guide rollers 76D to 76F, and the second roller 73B of the moving mechanism 71 are arranged on the downstream side with respect to the platen roller 29 in the medium path P. Although a specific explanation will be given later on, the first roller 73A and the second roller 73B are moved in the left-right direction to thereby guide the print medium 8. With this, the medium path P is changed.

As depicted in FIG. 9B, the guide roller 76C (third roller 73C) is disposed, in the medium path P, between the platen roller 29 and the first roller 73A. A distance L11 in the left-right direction from the second rotation axis 29X of the platen roller 29 up to an end part, of the guide roller 76C (third guide roller 76C), located on the first side (namely, an end part, of the guide roller 76C, on the opposite side to the second rotation axis 29X) is greater than a distance L12 in the left-right direction from the second rotation axis 29X of the platen roller 29 up to an end part, of the first roller 73A, located on the second side (namely, an end part, of the first roller 73A, facing the second rotation axis 29X) in a case that the moving mechanism 71 is positioned to be closest to the first side in the moving range S. Further, the guide roller 76C (third roller 76C) is arranged on the first side in the left-right direction with respect to the end on the first side of the moving range S. Therefore, a distance in the left-right direction from the second rotation axis 29X of the platen roller 29 up to the third rotation axis 763X of the guide roller 76C (third roller 76C) is greater than a distance in the left-right direction from the second rotation axis 29X of the platen roller 29 up to the end on the first side of the moving range S. Note that in this case, the positions in the left-right direction of the moving mechanism 71 and the guide roller 76C are not overlapped with each other. Therefore, for example, in the up/down direction, it is allowable to arrange a position of the upper end part of the moving mechanism 71 to be located above (on the upper side with respect to) a position of the lower end part of the guide roller 76C. In this case, since the arrangement space in the up-down direction of the moving mechanism 71 and the guide roller 76C can be made small, thereby making it possible to realize a small-sized printing apparatus 1.

As depicted in FIG. 9A, the guide roller 76D (fourth roller 76D) is disposed, in the medium path P, between the platen roller 29 and the second roller 73B. A distance L21 in the left-right direction from the second rotation axis 29X of the platen roller 29 up to an end part, of the guide roller 76D (fourth guide roller 76D), located on the second side (namely, an end part, of the guide roller 76D, on the opposite side to the second rotation axis 29X) is greater than a distance L22 in the left-right direction from the second rotation axis 29X of the platen roller 29 up to an end part, of the second roller 73B, located on the first side (namely, an end part, of the second roller 73B, facing the second rotation axis 29X) in a case that the moving mechanism 71 is positioned to be closest to the second side in the moving range S. Further, the guide roller 76D (fourth roller 76D) is arranged on the second side in the left-right direction with respect to the end on the second side of the moving range S. Therefore, a distance in the left-right direction from the second rotation axis 29X of the platen roller 29 up to the fourth rotation axis 764X of the guide roller 76D (fourth roller 76D) is greater than a distance in the left-right direction from the second rotation axis 29X of the platen roller 29 up to the end on the second side of the moving range S. Note that in this case, the positions in the left-right direction of the moving mechanism 71 and the guide roller 76D are not overlapped with each other. Therefore, for example, in the up/down direction, it is allowable to arrange a position of the upper end part of the moving mechanism 71 to be located above a position of the lower end part of the guide roller 76D. In this case, since the arrangement space in the up-down direction of the moving mechanism 71 and the guide roller 76D can be made small, thereby making it possible to realize a small-sized printing apparatus 1.

Further, the second rotation axis 29X of the platen roller 29 is arranged in the center in the left-right direction of the moving range S. Accordingly, the distance L11 and the distance L21 are same with each other, and the distance L12 and the distance L22 are same with each other.

As depicted in FIGS. 9A and 9B, a moving velocity of the print medium 8, at a position of the print medium 8 at which the print medium 8 makes contact with the platen roller 29, is expressed as a "print position velocity Wp". The moving velocity of the print medium 8, at a position on the opposite side to the platen roller 29, in other words, at a position on the upstream side with respect to the first roller 73A, or at a position on the downstream side with respect to the second roller 73B corresponds to the conveyance position velocity. The conveyance position velocity is expressed as the "conveyance position velocity Wt". The conveyance position velocity Wt corresponds to a conveying velocity in a case that the print medium 8 is supplied to the conveying section 7 of the printing apparatus 1 from the external apparatus 100. As depicted in FIG. 9A, in a case that the moving mechanism 77 stands still, the print position velocity Wp is coincident with the conveyance position velocity Wt.

Figure 9C:
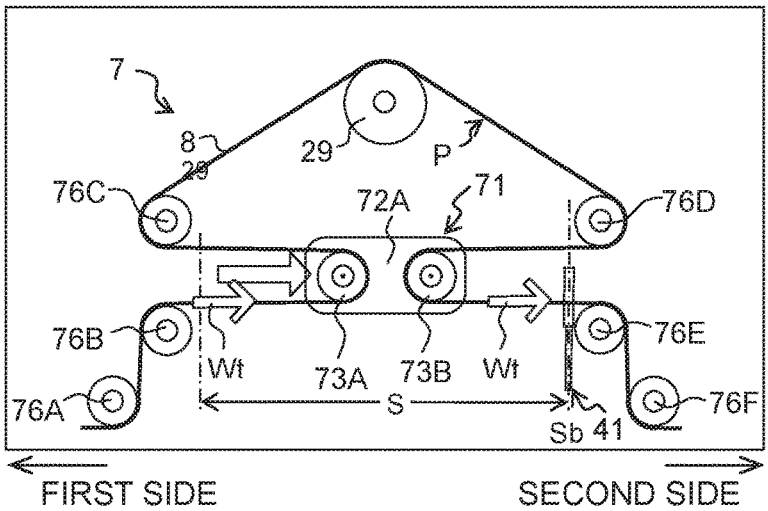

On the other hand, as depicted in FIG. 9B, a part of the medium path P which is located between the platen roller 29 and the first roller 73A becomes short and a part of the medium path P which is located between the platen roller 29 and the second roller 73B becomes long, in response to the movement of the moving mechanism 71 toward the first side. In this case, a force toward the downstream side acts on a part, of the print medium 8, on the side of the platen roller 29 with respect to the moving mechanism 71. This consequently makes the print position velocity Wp to be faster than the conveyance position velocity Wt. On the other hand, as depicted in FIG. 9C, the part of the medium path P which is located between the platen roller 29 and the first roller 73A becomes long and the part of the medium path P which is located between the platen roller 29 and the second roller 73B becomes short, in response to the movement of the moving mechanism 71 toward the second side. In this case, a force toward the upstream side acts on the part, of the print medium 8, on the side of the platen roller 29 with respect to the moving mechanism 71. This consequently makes the print position velocity Wp to be slower than the conveyance position velocity Wt, and becomes 0.

<Overview of Printing Operation by Printing Apparatus 1>

An explanation will be given about the overview of a printing operation by the printing apparatus 1, with reference to FIG. 1 and FIGS. 10A to 10E. The following explanation is given on a premise that the external apparatus 100 supplies the print medium 8 to the printing apparatus 1 at the conveyance position velocity Wt (see FIGS. 9A to 9C) and that the moving mechanism 71 (see FIGS. 9A to 9C) stands still at the reference position Sb (see FIG. 9A). Since the moving mechanism 71 is not moved, the print position velocity Wp is coincident with the conveyance position velocity Wt (see FIG. 9A).

As depicted in FIGS. 10A to 10E, a plurality of pieces of an eye mark m (m(1), m(2) . . . ) are printed in advance on the print medium 8 respectively at predetermined positions (for example, positions closer to an end part in the width direction of the print medium 8). The eye marks m are arranged at equal intervals in the length direction of the print medium 8, with a predetermined spacing distance D1 therebetween. The external apparatus 100 is provided with an optical sensor 101 capable of detecting the eye marks m of the print medium 8. The optical sensor 101 is disposed on the outside of the printing apparatus 1, for example, at a part or portion, of the medium path P, which is located adjacently on the downstream side with respect to a position at which the print medium 8 makes contact with the guide roller 76F (see FIG. 1), or located adjacently on the upstream side with respect to a position at which the print medium 8 makes contact with the guide roller 76A. The following explanation will be given with a case, as an example, in which the optical sensor 101 is arranged at the part or portion, of the medium path P, which is located on the downstream side with respect to the position at which the print medium 8 makes contact with the guide roller 76F (see FIG. 1). Note that for the purpose that the explanation will be easily understood, in FIGS. 10A to 10E, the ink ribbon 9 and the print medium 8 are depicted in a linearly manner and the ink ribbon 9 and the print medium 8 are away from each other. In reality, however, the ink ribbon 9 is conveyed while being bent by the guide shafts 23 to 26 (see FIG. 1), and the print medium 8 is conveyed while being bent by the guide rollers 76A to 76F (see FIG. 1). Further, the ink ribbon 9 and the print medium 8 make contact with each other at least at a position at which the thermal head 28 makes contact with the ink ribbon 9.

Figure 10A:
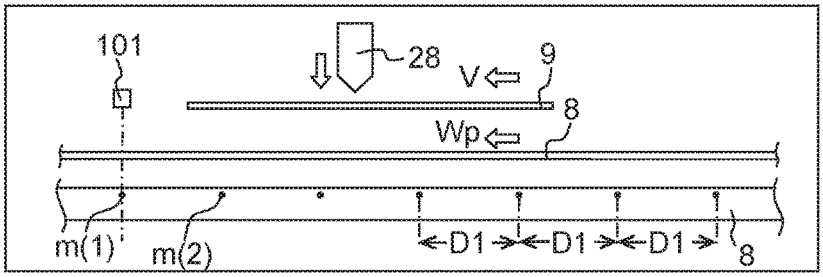
FIGS. 10A to 10E are views for explaining the overview of a printing operation.

As depicted in FIG. 10A, the thermal head 28 is arranged at the print stand-by position 28B (see FIG. 1). The external apparatus 100 starts the conveyance of the print medium 8. In a case that the external apparatus 100 detects the eye mark m(1) by the optical sensor 101, the external apparatus 100 outputs a signal (referred to as a "print signal"), indicating that the print medium 8 is located at a printable position, to the printing apparatus 1.

In a case that the printing apparatus 1 receives the print signal, the printing apparatus 1 rotates the shafts 21 and 22 (see FIG. 1) to thereby convey the ink ribbon 9. In a case that a conveying velocity of the ink ribbon 9 (referred to as a "ribbon velocity V") is increased up to a desired velocity, the thermal head 28 is moved from the print stand-by position 28B to the print position 28A (see FIG. 1). The desired velocity is same, for example, as the print position velocity Wp (see FIGS. 9A and 9B). In a case that the reduction in the usage amount of the ink ribbon 9 is desired, the desired velocity may be set, for example, to be a velocity slower than the print position velocity Wp (for example, a velocity slower than the print position velocity Wp by several percent to several tens of a percent). The following explanation will be given, as an example, with a case in which the desired velocity is same as the print position velocity Wp, for the purpose of simplification. The thermal head 28 makes contact with the platen roller 29 (see FIG. 1) from thereabove via the ink ribbon 9 and the print medium 8. The ink ribbon 9 is pressed against a print surface of the print medium 8 in accordance with the movement of the thermal head 28. The platen roller 29 makes contact with a surface, of the print medium 8, on the opposite side to the print surface of the print medium 8, and presses the ink ribbon 9 and the print medium 8 against the thermal head 28. The conveyance direction and the conveying velocity of the ink ribbon 9 and those of the print medium 8, respectively, are coincident to each other at the position at which the ink ribbon 9 and the print medium 8 make contact with each other (Ribbon Velocity V=Print Position Velocity Wp=Conveyance Position Velocity Wt).

Figure 10B:
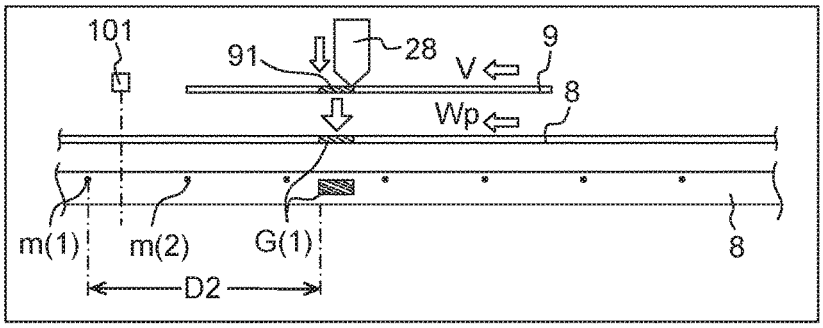

The thermal head 28 is heated. As depicted in FIG. 10B, the ink in a predetermined region 91 of the ink ribbon 9 is transferred onto the print surface of the print medium 8. In the manner as described above, a print image G(1) for one block corresponding to the eye mark m(1) is printed on the print medium 8. A length from the eye mark m(1) up to the print image G(1) is expressed as the length "D2". Note that when the print image G(1) is being printed, the print medium 8 and the ink ribbon 9 are continuously conveyed at a same velocity (Ribbon Velocity V=Print Position Velocity Wp). Note that the print position velocity Wp is not necessarily being limited as being constant; the print position velocity Wp is changed in accordance with a processing performed in the external apparatus 100, in some cases. Provided that the print position velocity Wp is changed, the printing apparatus 1 changes the ribbon velocity V in accordance with the change in the print position velocity Wp.

Figure 10C:
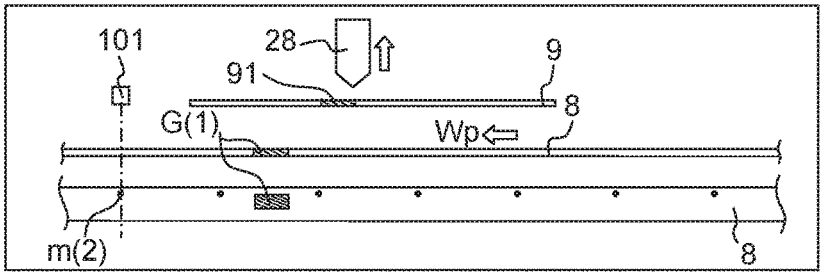

After the print image G(1) is printed, the heating of the thermal head 28 is stopped. As depicted in FIG. 10C, the thermal head 28 is moved from the print position 28A to the print stand-by position 28B. Here, when the printing is not executed, the rotations of the shafts 21 and 22 may be stopped and thus to stop the conveyance of the ink ribbon 9, in order to reduce the usage amount of the ribbon (Ribbon velocity V=0 (zero)). With this, the printing operation for printing the print image G(1) is ended. Note that since the print medium 8 is conveyed continuously by the external apparatus 100, the print position velocity Wp is maintained.

Figure 10D:
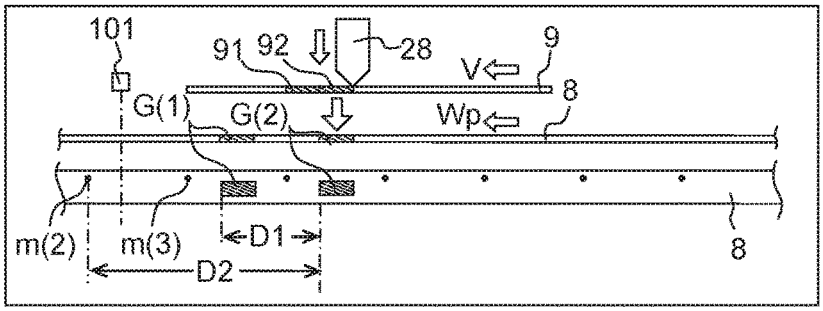

The print medium 8 is conveyed, and the next eye mark m(2) is detected by the optical sensor 101 (see FIG. 10C). In this case, the external apparatus 100 outputs the print signal to the printing apparatus 1. The printing apparatus 1 receives the print signal, and starts the printing operation for next one block. As depicted in FIG. 10D, the ink ribbon 9 is conveyed by the rotations of the shafts 21 and 22. The thermal head 28 is moved from the print stand-by position 28B to the print position 28A. The thermal head 28 is heated after having been moved to the print position 28A, and the ink in a predetermined region 92 of the ink ribbon 9 is transferred onto the print surface of the print medium 8. In the manner as described above, a print image G(2) corresponding to the eye mark m(2) is printed on the print medium 8. A length between the print image G(1) to the print image G(2) is same as the length between the eye marks m which is the length "D1". A length from the eye mark m(2) to the print image G(2) is same as the length D2 which is the length between the eye mark m(1) up to the print image G(1).

Figure 10E:
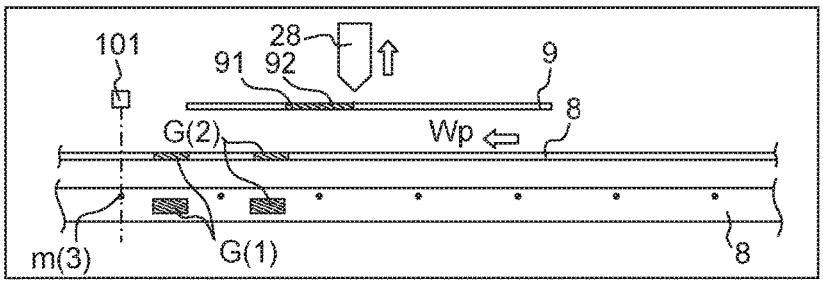

After the print image G(2) is formed, the heating of the thermal head 28 is stopped. As depicted in FIG. 10E, the thermal head 28 is moved from the print position 28A to the print stand-by position 28B. The conveyance of the ink ribbon 9 is stopped (Ribbon Velocity V=0 (zero)). In the manner as described above, the printing operation for the print image G(2) is ended.

<Control of Print Position Velocity Wp by Movement of Moving Mechanism 71>

There is such a case that the conveyance position velocity Wt of the print medium 8 by the external apparatus 100 is decelerated. In this case, in a case that the print position velocity Wp of the print medium 8 becomes not more than a predetermined velocity Vth, there is such a possibility that the printing apparatus 1 might not be able to maintain a satisfactory printing quality. The reason for this is that the ribbon velocity V is adjusted with respect to (based on) the print position velocity Wp; and thus if the print position velocity Wp is not more than the predetermined velocity Vth, a narrower region of the ink ribbon 9 is heated by the thermal head 28 for a long period of time than in another case that the print position velocity Wp is not less than the predetermined velocity Vth. In this case, the temperature of the heated region of the ink ribbon 9 is increased to be higher than an appropriate temperature, and an image is reversely transferred onto the print medium 8 and/or the ink ribbon 9, any bleeding and/or faintness of the ink, etc. is/are easily occurred. The predetermined velocity Vth is a value determined by the characteristics of the thermal head 28 and the ink ribbon 9, and is assumed to be stored in advance in the storing section 32 at a time of shipment of the printing apparatus 1 from the factory. Note that the predetermined velocity Vth may be appropriately set by a user via the operating section 36 (see FIG. 12).

Accordingly, in a case that the print position velocity Wp of the print medium 8 becomes not more than the predetermined velocity Vth, the printing apparatus 1 allows the clutch 68 to be in the connected state and causes the motor 77 to rotate toward the one direction. With this, the moving mechanism 77 is moved toward the first side (see FIG. 9B). In response to the movement of the moving mechanism 71 toward the first side, the print position velocity Wp is accelerated, and becomes to be greater than the conveyance position velocity Wt (see FIG. 9B). With this, the printing apparatus 1 is in a state that the print position velocity Wp is greater than the predetermined velocity Vth, thereby maintaining a satisfactory printing quality.

On the other hand, in response to the moving mechanism 71 caused to move from the reference position toward the first side, the medium path P between the platen roller 29 and the second roller 73B becomes long (see FIG. 9B). In a case that the printing operation is executed in this state, the length D2 (see FIGS. 10B, 10D) between an eye mark m(i) ("i" is an integer) and a print image G(i) corresponding to the eye mark m(i) becomes longer to an extent corresponding to the elongation of the length of the medium path P between the platen roller 29 and the second roller 73B, than in a case that the printing operation is executed in a state that the moving mechanism 71 is arranged at the reference position. In this case, there is such a case that it might not be possible to print the print image G(i) corresponding to the eye mark m(i) at a desired position in the print medium 8. For this reason, the printing apparatus 1 preferably starts the printing operation for printing the image G(i), in the state that the moving mechanism 71 is arranged at the reference position.

In view of the above-described situation, the printing apparatus 1 moves the moving mechanism 71 toward the second side so as to arrange the moving mechanism 71 at the reference position, after a printing operation for a print image G(i-1) is ended and before a printing operation for a next print image G(i) is started. This is performed specifically in a following manner. For example, the printing apparatus 1 allows the clutch 68 to be in the cutoff state after the printing operation for the print image G(i-1) is ended and before the printing operation for the next print image G(i) is started. Note that even after the clutch 68 is allowed to be in the cutoff state, the print medium 8 is continuously conveyed by the external apparatus 100. In this case, as depicted in FIG. 11A, a force F1 toward the first side received by the first roller 73A from the print medium 8 becomes smaller than a force F2 toward the second side received by the second roller 73B from the print medium 8. The reason for this is that the print medium 8 is supplied to the printing apparatus 1 from the side of the first roller 73A among the medium path P, and thus the tension (tensile force) acting on the first roller 73A from the print medium 8 becomes smaller than the tension acting on the second roller 73B by the print medium 8. Accordingly, in the case that the clutch 68 is allowed to be in the cutoff state, the moving mechanism 71 is moved toward the second side and to the reference position, and reaches the reference position (see FIG. 11B). The printing apparatus 1 starts the printing operation for the next print image G(i) after the moving mechanism 71 has moved up to the reference position. With this, the printing apparatus 1 is capable of making the length D2 from the eye mark m(i) to the print image G(i) be constant, thereby making it possible to print the print image G(i) corresponding to the eye mark m(i) at a desired position in the print medium 8.

<Electrical Configuration of Printing Apparatus 1>

An explanation will be given about the electrical configuration of the printing section 2 and the conveying section 7 of the printing apparatus 1. As depicted in FIG. 12, the printing section 2 is provided with a controller 31, the storing section 32, the operating section 36, the driving circuit 37, the motors 33 to 35, the thermal head 28, the communication interface (I/F) 38 and the connection I/F 39. The conveying section 7 is provided with the driving circuit 40, the first sensor 41, the second sensor 42, the motor 77, the clutch 68 and the connection I/F 44.

The controller 31 includes a CPU controlling the printing section 2 and the conveying section 7; a ROM storing respective kinds of initial parameters; a RAM temporarily storing information; etc. The controller 31 is electrically connected to the storing section 32, the operating section 36, the driving circuit 37, the communication I/F 38 and the connection I/F 39 via a non-illustrated interface circuit.

The storing section 32 stores a program of a processing executed by the controller 31, a print data, a variety of kinds of setting information, etc. The program, the print data, and the variety of kinds of setting information may be read, for example, from a USB memory connected to the communication I/F 38 (to be described later on). Further, in a case that a SD card is connectable to the communication I/F 38 as will be describe later on, the program, print data and variety of kinds of setting information may be read from the SD card connected to the communication I/F 38. The controller 31 may store the read program, print data and variety of kinds of setting information in the storing section 32. The variety of kinds of setting information may be input, for example, via the operating section 36 (to be described in the following). The controller 31 may store the input variety of kinds of setting information in the storing section 32.

The operating section 36 is an interface (a button, a touch panel, etc.) to which a variety of kinds of information can be input. The driving circuit 37 includes, for example, a circuit, etc., configured to output a signal to each of the motors 33 to 35 and the thermal head 28. The motors 33 to 35 are each a stepping motor which is rotated synchronizing with a pulse signal. The motor 33 rotates the shaft 21. The motor 34 rotates the shaft 22. The motor 35 moves the thermal head 28 between the print position 28A (see FIG. 1) and the print stand-by position 28B (see FIG. 1) via a non-illustrated head holding mechanism. The thermal head 28 is a line thermal head having a plurality of heating elements which are linearly arranged side by side in the front-rear direction. Each of the plurality of heating elements is selectively heated in accordance with a signal output from the controller 31. The communication I/F 38 is an interface element configured to perform communication between the printing section 2 and the external apparatus 100 which is connected to the printing section 2, based on a universal standard (for example, USB standard). The connection I/F 39 is an interface element configured to perform communication based on a universal standard (for example, LVDS (Low Voltage Differential Signaling) standard, etc.). The connection I/F 39 and the connection I/F 44 of the conveying section 7 (to be described later on) are connected to each other via a cable supporting the LVDS standard. A communication based on the LVDS standard is executed between the connection I/F 39 and the connection I/F 44.

The driving circuit 40 includes a circuit configured to detect a signal output from the controller 31 of the printing section 2 via the connection I/F 39 and the connection I/F 44, and to output the detected signal to the motor 77 and the clutch 68. Further, the driving circuit 40 includes a circuit configured to detect a signal output from each of the first sensor 41 and the second sensor 42, and to output the detected signals to the controller 31 via the connection I/F 44 and the connection I/F 39; etc. The connection I/F 44 is an interface element configured to perform communication based on a variety of kinds of universal standard.

In the following, an operation or action in which the controller 31 outputs a signal to the motors 33 to 35 via the driving circuit 37 is simply referred to that "the controller 31 outputs a signal to the motors 33 to 35"; an operation or action in which the controller 31 outputs a signal to the motor 77 and the clutch 68 via the connections I/F 39 and 44 and the driving circuit 40 is simply referred to that "the controller 31 outputs a signal to the motor 77 and the clutch 68"; and an operation or action in which the controller 31 detects a signal output from each of the first sensor 41 and the second sensor 42 via the driving circuit 40, the connection I/F 44 and the connection I/F 39 is simply referred to that "the controller 31 detects a signal output from each of the first sensor 41 and the second sensor 42".

The first sensor 41 outputs, to the driving circuit 40, a signal in accordance with the presence/absence of detection of the first supporting member 72A by the detector 41A. A signal output from the first sensor 41 in a state that the first supporting member 72A is detected by the detector 41A is referred to as an "ON signal". A signal output from the first sensor 41 in a state that the first supporting member 72A is not detected by the detector 41A is referred to as an "OFF signal". In a case that the shaft 422 is rotated in accordance with the rotation of the platen roller 29, the second sensor 42 outputs a signal in accordance with the rotation amount of the shaft 422 to the driving circuit 40.

The motor 77 is, for example, a so-called AC speed control motor in which a velocity detecting sensor is built in an AC motor. The motor 77 rotates the shaft 77B toward the one direction or the other direction, in accordance with a driving signal output from the driving circuit 40. A driving signal in a case of rotating the shaft 77B of the motor 77 toward the one direction is referred to as a "driving-toward-one-direction signal". A driving signal in a case of rotating the shaft 77B of the motor 77 toward the other direction is referred to as a "driving-toward-other-side signal". Note that it is allowable to use, as the motor 77, a stepping motor configured to rotate synchronizing with a pulse signal. The clutch 68 is switched between the connected state and the cutoff state depending on a switching signal.

<Main Processing>

An explanation will be given about a main processing with reference to FIGS. 13 to 17. The print medium 8 is installed in the conveying section 7 in a state that the conveyance of the print medium 8 by the external apparatus 100 is stopped. The print medium 8 is arranged along the medium path P. The external apparatus 100 outputs a first starting instruction for starting the printing operation to the printing apparatus 1, in a state that the conveyance of the print medium 8 is stopped. The controller 31 detects the first starting instruction via the communication I/F 38. The controller 31 reads and executes the program stored in the storing section 32, to thereby start the main processing. As depicted in FIG. 13, at first, the controller 31 executes an initialization processing (S11; see FIG. 15).

An explanation will be given about the initialization processing with reference to FIG. 15. The controller 31 outputs the switching signal to the clutch 68, and allows the clutch 68 to be in the connected state (S71). The controller 31 starts the outputting of the driving-toward-other-side signal to the motor 77. The shaft 77B of the motor 77 starts to rotate toward the other direction (S73). Since the clutch 68 is allowed to be in the connected state by the processing of step S71, the transmitting mechanism 6 transmits the rotation driving force of the motor 77 to the moving mechanism 71. In the case that the moving mechanism 71 is arranged closer to the first side than the reference position, the moving mechanism 71 is moved to the second side toward the reference position. Namely, a timing at which the rotation of the motor 77 toward the other direction is started can be expressed also as any one among the following timings (1) and (2). Namely:

Timing (1): before the conveyance of the print medium 8 by the external apparatus 100 is started, namely, in a case that both of the print position velocity Wp and the conveyance position velocity Wt are 0; and Timing (2): before the print signal is received, more specifically, after the power of the printing apparatus 1 is switched ON and before the print signal is received from the external apparatus 100 for the first time and the printing operation is started.

As depicted in FIG. 17A, in a case that the moving mechanism 71 is moved toward the second side, the medium path P between the platen roller 29 and the first roller 73A becomes long, and the medium path P between the platen roller 29 and the second roller 73B becomes short. Here, since there is provided a state wherein the conveyance of the recording medium 8 by the external apparatus 100 is stopped, a part or portion, of the recording medium 8, on the side opposite to the side of the platen roller 29, with the moving apparatus 71 as the reference, is not moved. Accordingly, a part or portion, of the recording medium 8, on the side of the platen roller 29, with the moving apparatus 71 as the reference, is moved toward the upstream side in accordance with the movement of the moving mechanism 71 toward the second side (arrows Y3). The platen roller 29 is rotated in accordance with the movement of the print medium 8 (an arrow Y4).

As depicted in FIG. 15, the controller 31 detects the signal output from the first sensor 41 (S75). In a case that the detected signal is the OFF signal, the controller 31 determines that the first supporting member 72A is not detected by the detector 41A of the first sensor 41 (S77: NO). In this case, the controller 31 returns the processing to step S75. After a first predetermined time (for example, 1 μs) has elapsed, the controller 31 detects the signal output from the first sensor 41 (S75), and repeats the determination of step S77. In a case that the detected signal is the ON signal, the controller 31 determines that the first supporting member 72A is detected by the detector 41A of the first sensor 41 (S77: YES). In this case, the controller 31 advances the processing to step S79.

Note that in a case that the end part on the second side of the first supporting member 72A is arranged in the detecting range, the first sensor 41 outputs the ON signal in response to the detection of the first supporting member 72A by the detector 41A. Accordingly, also after the end part on the second side of the first supporting member 72A has been detected by the detector 41A, the moving mechanism 71 is continuously being moved toward the second side while the end part on the second side of the first supporting member 72A is being moved in the detecting range toward the second side. In this case, the platen roller 29 is continuously rotated. On the other hand, in a case that the moving mechanism 71 reaches the reference position, the movement of the moving mechanism 71 toward the second side is stopped. In this case, the rotation of the platen roller 29 is also stopped.

The controller 31 detects the signal output from the second sensor 42 (S79). The controller 31 specifies, based on the detected signal, whether the platen roller 29 is continuously rotating after the first supporting member 72A has been detected by the detector 41A of the first sensor 41. More specifically, in a case that the Hi signal and the Low signal are alternately output in a repeated manner from the second sensor 42, the controller 31 specifies that the platen roller 29 is continuously rotating. On the other hand, in a case that the Hi signal or the Low signal is continuously output from the second sensor 42, the controller 31 specifies that the platen roller 29 is stopped. In a case that the controller 31 specifies that the platen roller 29 is rotating, the controller 31 determines that the moving mechanism 71 is continuously moving toward the second side (S81: NO). In this case, the controller 31 returns the processing to step S79. After the first predetermined time has elapsed, the controller 31 detects the signal output from the second sensor 42 (S79), and repeats the determination of step S81.

In a case that the controller 31 specifies that the platen roller 29 is not rotating, the controller 31 further determines whether a state that the platen roller 29 is not rotating is continued for a second predetermined time (for example, 100 μs). In a case that the controller 31 determines that the state that a continuous time during which the platen roller 29 is not rotating is continued is less than the second predetermined time (S81: NO), the controller 31 returns the processing to step S79. After the first predetermined time has elapsed, the controller 31 detects the signal output from the second sensor 42 (S79), and repeats the determination of step S81. In a case that the controller 31 determines that the state that the platen roller 29 is not rotating is continued for the second predetermined time, the controller 31 determines that the moving mechanism 71 has reached the reference position and has stopped (S81: YES). In this case, the controller 31 stops the output of the driving-toward-other-side signal with respect to the motor 77 which has been started by the processing in step S73. The rotation of the shaft 77B of the motor 77 toward the other direction is stopped (S83). Note that the clutch 68 is maintained to be in the connected state.

As described above, the second sensor 42 outputs the rotation amount of the platen roller 29 in a state that the conveyance of the print medium 8 by the external apparatus 100 is stopped and that the clutch 68 is allowed to be in the connected state and the motor 77 is rotated toward the other direction, thereby functioning as a sensor capable of detecting the movement (or stopping) of the moving mechanism 71.

The controller 31 starts the output of the driving-toward-one-direction signal with respect to the motor 77. The shaft 77B of the motor 77 is started to rotate toward the one direction (S85). Since the clutch 68 is maintained in the connected state, the transmitting mechanism 6 transmits the rotation driving force of the motor 77 to the moving mechanism 71. The moving mechanism 71 is moved from the reference position toward the first side.

As depicted in FIG. 17B, in a case that the moving mechanism 71 is moved toward the first side, the medium path P between the platen roller 29 and the first roller 73A becomes short, and the medium path P between the platen roller 29 and the second roller 73B becomes long. However, since there is provided the state that the conveyance of the recording medium 8 by the external apparatus 100 is stopped, the part or portion, of the recording medium 8, on the side opposite to the side of the platen roller 29, with the moving apparatus 71 as the reference, is not moved. Accordingly, the part or portion, of the recording medium 8, on the side of the platen roller 29, with the moving apparatus 71 as the reference, is moved toward the downstream side in accordance with the movement of the moving mechanism 71 toward the first side (arrows Y5). The platen roller 29 is rotated in accordance with the movement of the print medium 8 (an arrow Y6). Note that idealistically, the moving amount of the print medium 8 is twice the moving amount of the moving mechanism 71.

As depicted in FIG. 15, the controller 31 detects the signal output from the second sensor 42 for a third predetermined time (for example, 1 s). The controller 31 calculates the rotation amount of the shaft 422 of the rotary encoder 42A based on the signal detected from the second sensor 42. The controller 31 calculates the rotation amount of the platen roller 29 based on the calculated rotation amount of the shaft 422 and the ratio of the diameter of the rotating plate 42B to the diameter of the platen roller 29. The controller 31 calculates the moving amount of the print medium 8 based on the calculated rotation amount of the platen roller 29 and the diameter of the platen roller 29. The controller 31 specifies a moving amount (referred to as a "first moving amount M1") of the moving mechanism 71, by dividing the calculated moving amount of the print medium 8 by 2 (S87).

The controller 31 calculates the rotating velocity of the shaft 77B based on the driving-toward-other-side signal output to the motor 77 within the third predetermined time after the rotation of the shaft 77B of the motor 77 toward the one direction has been started by the processing of step S85. The controller 31 multiplies the calculated rotation velocity of the shaft 77B by an outputting time during which the driving-toward-other-side signal is output, thereby calculating the rotation amount of the shaft 77B toward the other direction. The controller 31 calculates the rotation amount of the driving shaft 63 based on the calculated rotation amount of the shaft 77B and the ratio of the diameter of the first pulley 64 to the diameter of the second pulley 65. The controller 31 calculates a moving amount (referred to as a "second moving amount M2") of the moving mechanism 71, based on the calculated rotation amount of the driving shaft 63 and the gear ratio of the rack gear 61 and the gear ratio of the pinion gear 62 (S89).

The controller 31 determines whether the difference between the first moving amount M1 calculated by the processing in step S87 and the second moving amount M2 calculated by the processing in step S89 is not more than a predetermined value (S91). In a case that the controller 31 determines that the difference between the first moving amount M1 and the second moving amount M2 is more than the predetermined value (S91: NO), the controller 31 advances the processing to step S93. In this case, for example, there is possibility that any one of the following phenomena (a) to (c) might occur. Namely:

(a) the motor 77 steps out (provided that the motor 77 is a stepping motor);

(b) a phenomenon that the print medium 8 is slipped with respect to the platen roller 29 to thereby cause idle turning; and (c) the belt 66 is detached from the first pulley 64 and the second pulley 65.

The controller 31 outputs an error signal, indicating that the moving mechanism 71 is not moved to an intended position, to the external apparatus 100 via the communication I/F 38 (S93). The controller 31 ends the initialization processing and returns the processing to the main processing (see FIG. 13). In a case that the controller 31 determines that the difference between the first moving amount M1 and the second moving amount M2 is within the predetermined value (S91: YES), the controller 31 advances the processing to step 5101 (see FIG. 16).

As depicted in FIG. 16, the controller 31 starts the output of the driving-toward-other-side signal to the motor 77. The shaft 77B of the motor 77 starts to rotate toward the other direction (S101). Since the clutch 68 is maintained in the connected state, the transmitting mechanism 6 transmits the rotation driving force of the motor 77 to the moving mechanism 71. The moving mechanism 71 is moved toward the second side to the reference position. The controller 31 detects the signal output from the first sensor 41 (S103). In a case that the detected signal is the OFF signal, the controller 31 determines that the first supporting member 72A is not detected by the detector 41A of the first sensor 41 (S105: NO). In this case, the controller 31 returns the processing to step S103. After the first predetermined time has elapsed, the controller 31 detects the signal output from the first sensor 41 (S103), and repeats the determination of step S105.

In a case that the detected signal is the ON signal, the controller 31 determines that the first supporting member 72A is detected by the detector 41A of the first sensor 41 (S105: YES). In this case, the controller 31 advances the processing to step 5107. The controller 31 detects the signal output from the second sensor 42 (S107). Based on the detected signal, the controller 31 specifies whether or not the platen roller 29 is rotating after the first supporting member 72A has been detected by the detector 41A of the first sensor 41. In a case that the controller 31 specifies that the platen roller 29 is rotating, the controller 31 determines that the end part on the second side of the first supporting member 72A of the moving mechanism 71 is continuously moving in the detecting range toward the second side (S109: NO). In this case, the controller 31 returns the processing to step S107. After the first predetermined time has elapsed, the controller 31 detects the signal output from the second sensor 42 (S107), and repeats the determination of step S109.

In a case that the controller 31 specifies that the platen roller 29 is not rotating, the controller 31 further determines whether the state that the platen roller 29 is not rotating is continued for the second predetermined time. In a case that the controller 31 determines that the state that the continuous time during which the platen roller 29 is not rotating is continued is less than the second predetermined time (S109: NO), the controller 31 returns the processing to step S107. After the first predetermined time has elapsed, the controller 31 detects the signal output from the second sensor 42 (S107), and repeats the determination of step S109. In a case that the controller 31 determines that the state that the platen roller 29 is not rotating is continued for the second predetermined time, the controller 31 determines that the moving mechanism 71 has reached the reference position and has stopped (S109: YES). In this case, the controller 31 stops the output of the driving-toward-other-side signal with respect to the motor 77 which has been started by the processing in step S101. The rotation of the shaft 77B of the motor 77 toward the other direction is stopped (S111). The controller 31 ends the initialization processing, and returns the processing to the main processing (see FIG. 13).

As depicted in FIG. 13, after the initialization processing (S11) has been ended, the controller 31 detects the signal output from the first sensor 41 (S13). Note that the controller 31 has already detected the ON signal (S105: YES, see FIG. 16) by the processing of step S105 (see FIG. 16) of the initialization processing (S11). Consequently, the ON signal is detected in the processing of step S13 which is executed immediately after the initialization processing (S11). Accordingly, the controller 31 determines that the first supporting member 72A is detected by the detector 41A of the first sensor 41 (S15: YES).

The controller 31 detects the signal output from the second sensor 42 (S17), and determines whether the moving mechanism 71 is stopped at the reference position (S19). Note that the controller 31 determines, by the processing of step S109 (see FIG. 16) of the initialization processing (S11) that the state that the platen roller 29 is not rotating has continued for the second predetermined time (S109: YES, see FIG. 16). Consequently, the controller 31 determines in step S19 that the moving mechanism 71 is stopped at the reference position (S19: YES). Namely, in a case that the determination in step S15 is "S15: YES" and that the determination in step S19 is "S19: YES", the controller 31 determines that the moving mechanism 71 is stopped at the reference position.

The controller 31 outputs the switching signal to the clutch 68, so as to allow the clutch 68 to be in the connected state (S21). Note that the controller 31 has already output, to the clutch 68, the switching signal for allowing the clutch 68 to be in the connected state by the processing of step S71 (see FIG. 15) of the initialization processing (S11). Accordingly, the connected state of the clutch 68 is maintained in the processing of step S21 which is executed immediately after the initialization processing (S11). The controller 31 advances the processing to step S23.

The controller 31 determines whether the controller 31 receives the print signal, output from the external apparatus 100, via the communication I/F 38 (S23). In a case that the controller 31 determines that the controller 31 does not receive the print signal (S23: NO), the controller 31 returns the processing to step S23. The controller 31 repeats the determination whether the controller 31 has received the print signal. The conveyance of the print medium 8 is started by the external apparatus 100. In response to the start of the conveyance of the print medium 8, the eye mark m is detected by the optical sensor 101. The external apparatus 100 outputs the print signal to the printing apparatus 1. In a case that the controller 31 determines that the controller 31 has received the print signal via the communication I/F 38 (S23: YES), the controller 31 starts the printing operation for one block (S25).

The specific of the printing operation is as follows. The controller 31 drives the motors 33 and 34 (see FIG. 12) so as to rotate the shafts 21 and 22 (see FIG. 1), thereby conveying the ink ribbon 9. In a case that the ribbon velocity V of the ink ribbon 9 is increased up to the conveyance position velocity Wt (see FIGS. 9A to 9C), the controller 31 moves the thermal head 28 from the print stand-by position 28B up to the print position 28A (see FIG. 1). The controller 31 heats the thermal head 28 based on the print data stored in the storing section 32. In the manner as described above, the printing operation for one block is executed (see FIGS. 10A to 10E).

While the controller 31 is executing the printing operation, the controller 31 detects the signal output from the second sensor 42 (S27). The controller 31 calculates a rotation amount per unit time of the shaft 422 of the rotary encoder 42A based on the detected signal. The controller 31 calculates the rotating velocity of the platen roller 29 based on the calculated rotation amount per unit time of the shaft 422 and the ratio of the diameter of the rotating plate 42B to the diameter of the platen roller 29. The controller 31 calculates the moving velocity at a position, of the print medium 8, at which the print medium 8 makes contact with the platen roller 29, namely the print position velocity Wp, based on the calculated rotation velocity of the platen roller 29 and the diameter of the platen roller 29.

The controller 31 determines whether the calculated print position velocity Wp is not more than the predetermined velocity Vth (S29). In a case that the controller determines that the calculated print position velocity Wp is not more than the predetermined velocity Vth (S29: YES), the controller 31 advances the processing to step S31. The controller 31 starts the output of the driving-toward-one-direction signal to the motor 77 so as to accelerate the print position velocity Wp. The shaft 77B of the motor 77 starts to rotate toward the one direction (S31). Since the clutch 68 is maintained at the connected state (see S21), the transmitting mechanism 6 transmits the rotation driving force of the motor 77 to the moving mechanism 71. The moving mechanism 71 is moved from the reference position toward the first side. Note that the controller 31 adjusts the driving-toward-one-direction signal which is output to the motor 77 such that the moving velocity of the moving mechanism 71 in the case that the moving mechanism 71 is moved toward the one direction becomes not less than ½ the predetermined velocity Vth. The print position velocity Wp becomes greater than the conveyance position velocity Wt, and is accelerated until the print position velocity Wp becomes not less than the predetermined velocity Vth. The controller 31 advances the processing to step S33. On the other hand, in a case that the controller 31 determines that the calculated print position velocity Wp is greater than the predetermined velocity Vth (S29: NO), the controller 31 advances the processing to step S33.

The controller 31 determines whether the printing operation for one block has been ended (S33). In a case that the controller 31 determines that the printing operation for one block has not been ended (S33: NO), the controller 31 returns the processing to step S27. After the first predetermined time has passed, the controller 31 detects the signal output from the second sensor 42 (S27), and repeats the determination of step S29.

In a case that the printing operation for one block has been ended (S33: YES), the controller 31 stops the heating of the thermal head 28. The controller 31 moves the thermal head 28 from the print position 28A up to the print stand-by position 28B. The controller 31 stops the rotations of the shafts 21 and 22 to thereby stop the conveyance of the ink ribbon 9 (see FIGS. 10A to 10E). The controller 31 advances the processing to step S51 (see FIG. 14).

As depicted in FIG. 14, in a case that the controller 31 moves the moving mechanism 71 toward the first side by the processing of step S31 (see FIG. 13), the controller 31 calculates the rotation velocity of the shaft 77B based on the driving-toward-one-direction signal output to the motor 77. The controller 31 multiplies the calculated rotation velocity of the shaft 77B by an outputting time during which the driving-toward-one-direction signal is output, thereby calculating the rotation amount of the shaft 77B toward the one direction. The controller 31 calculates the rotation amount of the driving shaft 63 based on the calculated rotation amount of the shaft 77B and the ratio of the diameter of the first pulley 64 to the diameter of the second pulley 65. The controller 31 calculates the moving amount of the moving mechanism 71, based on the calculated rotation amount of the driving shaft 63 and the gear ratio of the rack gear 61 and the gear ratio of the pinion gear 62. Further, the controller 31 calculates the moving velocity of the moving mechanism 71 based on a change amount per unit time of the calculated moving amount (S51).

The controller 31 obtains the print position velocity Wp calculated during the execution of the printing processing. Here, idealistically, the print position velocity Wp becomes a value obtained by adding, to the conveyance position velocity Wt, a value obtained by doubling the moving velocity of the moving mechanism 71 (hereinafter referred to as an "assumed velocity"). The controller 31 determines whether the obtained print position velocity Wp is not less than the assumed velocity (S53). In a case that the controller 31 determines that the print position velocity Wp is less than the assumed velocity (S53: NO), the controller 31 advances the processing to step S61. In this case, the moving velocity of the moving mechanism 71 calculated based on the signal output from the second sensor 42 consequently does not correspond to the moving velocity of the moving mechanism 71 calculated based on the rotating velocity of the motor 77. In this case, for example, there is possibility that any one of the above-described phenomena (a) to (c) might occur. In such a case, the controller 31 outputs the error signal, indicating that the moving mechanism 71 is not moved to the intended position, to the external apparatus 100 via the communication I/F 38 (S61). The controller 31 returns the processing to step S13 (see FIG. 13).

On the other hand, in a case that the controller 31 determines that the obtained print position velocity Wp is not less than the assumed velocity (S53: YES), the controller 31 advances the processing to step S55.

The controller 31 outputs the switching signal to the clutch 68 and allows the clutch 68 to be in the cutoff state (S55). In a case that the controller 31 has started the rotation of the shaft 77B of the motor 77 by the processing of step S31 (see FIG. 13), the controller 31 stops the rotation of the shaft 77B of the motor 77 (S57). Note that in the case that the rotation of the shaft 77B of the motor 77 has been started by the processing of step S31 (see FIG. 13), the moving mechanism 71 is arranged at a position separated toward the first side with respect to the reference position. Note that even after the clutch 68 is allowed to be in the cutoff state, the print medium 8 is continuously conveyed by the external apparatus 100. In this case, the moving mechanism 71 starts to move toward the second side to the reference position (see FIG. 11A). Namely, the controller 31 allows the clutch 68 to be in the cutoff state by the processing of step S55 before the moving mechanism 71 reaches the reference position.

The controller 31 determines whether an operation for switching off the power source of the printing apparatus 1 is executed (S59). In a case that the controller 31 determines that the operation for switching off the power source of the printing apparatus 1 is executed (S59: YES), the controller 31 ends the main processing. In a case that the controller 31 determines that the operation for switching off the power source of the printing apparatus 1 is not executed (S59: NO), the controller 31 returns the processing to step S13 (See FIG. 13).

As depicted in FIG. 13, the controller 31 detects the signal output from the first sensor 41 (S13). In a case that the detected signal is the OFF signal, the controller 31 determines that the first supporting member 72A is not detected by the detector 41A of the first sensor 41 (S15: NO). In this case, the moving mechanism 71 has not reached the reference position. The controller 31 advances the processing to step S43. An explanation about step S43 will be given later on. In a case that the detected signal is the ON signal, the controller 31 determines that the first supporting member 72A is detected by the detector 41A of the first sensor 41 (S15: YES). In this case, the controller 31 advances the processing to step S17.

The controller 31 detects the signal output from the second sensor 42 (S17). The controller 31 specifies, based on the detected signal, whether or not the platen roller 29 is rotating after the first supporting member 72A has been detected by the detector 41A of the first sensor 41. In a case that the controller 31 specifies that the platen roller 29 is not rotating (S19: NO), the controller 31 determines that the moving mechanism 71 is continuously moving toward the second side (S19: NO). Namely, the moving mechanism 71 has not reached the reference position. In this case, the controller 31 advances the processing to step S43. An explanation about step S43 will be given later on.

In a case that the controller 31 specifies that the platen roller 29 is rotating, the controller 31 further determines whether the state that the platen roller 29 is rotating is continued for the second predetermined time. In a case that the controller 31 determines that the state that a continuous time during which the platen roller 29 is rotating is continued is less than the second predetermined time (S19: NO), the controller 31 advances the processing to step S43. The explanation about step S43 will be given later on.

In a case that the controller 31 determines that the state that the platen roller 29 is rotating is continued for the second predetermined time, the controller 31 determines that the moving mechanism 71 has reached the reference position and has stopped (S19: YES) (see FIG. 11B). In this case, the controller 31 advances the processing to step S21. The controller 31 outputs the switching signal to the clutch 68 which is allowed to be in the cutoff state by the processing of step S55 (see FIG. 14), and allows the clutch 68 to be in the connected state (S21). The explanation about steps 23 and thereafter will be omitted.

On the other hand, in a case that the controller 31 determines that the first supporting member 72A is not detected by the detector 41A of the first sensor 41 (S15: NO), or a continuous time during which the state that the platen roller 29 is rotating after the first supporting member 72A has been detected by the detector 41A is continued is less than the second predetermined time (S19: NO), the controller 31 determines whether the controller 31 has received the print signal, output from the external apparatus 100, via the communication I/F 38 (S43). In a case that the controller 31 determines that the controller 31 has not received the print signal (S43: NO), the controller 31 returns the processing to step S13.

On the other hand, in a case that the controller 31 determines that the controller 31 has received the print signal via the communication I/F 38 (S43: YES), the controller 31 advances the processing to step S45. In this case, consequently, the eye mark m is detected by the external apparatus 100 in a state that the moving mechanism 71 is not arranged at the reference position. In this case, there is such a possibility that it might not be possible to print the print image at a desired position in the print medium 8. The controller 31 outputs an error signal, indicating that the moving mechanism 71 is not arranged at the reference position, to the external apparatus 100 via the communication I/F 38 (S45). The controller 31 returns the processing to step S13.

The printing apparatus 1 controls the print position velocity Wp, which is the moving velocity of the print medium 8 at a position of the platen roller 29, by moving the moving mechanism 71 toward the first side or the second side along the left-right direction. In a case that the clutch 68 is in the connected state, the clutch 68 transmits the rotation driving force of the motor 77 to the moving mechanism 71, via the transmitting mechanism 6. In a case that the clutch 68 is in the cutoff state, the clutch 68 does not transmits the rotation driving force of the motor 77 to the moving mechanism 71. In a case that the print position velocity Wp becomes to be not more than the predetermined velocity Vth (S29: YES) while the printing operation is being executed (S25), the printing apparatus 1 allows the clutch 68 to be in the connected state and rotates the motor 77 toward the one direction (S31). In this case, the moving mechanism 71 is moved toward the first side (see FIG. 9B). With this, since the printing apparatus 1 is capable of accelerating the print position velocity Wp, the printing apparatus 1 is capable of suppressing any lowering in the print quality which would be otherwise caused by any lowering of the print position velocity Wp such that the print position velocity Wp becomes to be not more than the predetermined velocity Vth.

On the other hand, in a case that the printing operation is ended (S33: YES) and that the moving mechanism 71 is arranged at a position closer toward the first side with respect to the reference position, the printing apparatus 1 allows the clutch 68 to be in the cutoff state (S55) until the moving apparatus 71 reaches the end on the second side of the moving range S. In this case, the moving mechanism 71 is allowed to be in a freely movable state in the left-right direction. The moving mechanism 71 is moved toward the second side with the force received by the moving mechanism 71 from the print medium 8 (see FIG. 11B). Namely, the printing apparatus 1 is capable of moving the moving mechanism 71 toward the second side by the force received from the print medium 8, without requiring the rotation driving force of the motor 77. Accordingly, the printing apparatus 1 is capable of easily executing the control for moving the moving mechanism 71 toward the second side to thereby return the moving mechanism to the reference position.

After the printing apparatus 1 allows the clutch 68 to be in the connected state by the processing of step S21, the printing apparatus 1 stars the rotation of the motor toward the one direction (S31). In this case, the printing apparatus 1 is capable of transmitting the rotation driving force of the motor 77 to the moving mechanism 71 efficiently immediately after the start of rotation of the motor 77, to thereby move the moving mechanism 71 toward the first side.

After the printing apparatus 1 allows the clutch 68 to be in the cutoff state (S55), the printing apparatus 1 stops the rotation of the motor 77 toward the one direction (S57). Accordingly, the printing apparatus 1 is capable of preventing the rotation driving force, which is decelerated immediately before the motor 77 is stopped, from being transmitted to the moving mechanism 71. Further, the movement of the moving mechanism 71 toward the first side is stopped in the case that the clutch 68 is allowed to be in the cutoff state, and then the moving mechanism 71 starts to move toward the second side with the force received by the moving mechanism 71 from the print medium 8. Accordingly, the printing apparatus 1 is capable of stopping the movement of the moving mechanism 71 toward the first side, at a timing at which the printing apparatus 1 allows the clutch 68 to be in the cutoff state; thus, the printing apparatus 1 is capable of stopping the movement of the moving mechanism 71 toward the first side, at an appropriate timing.

The printing apparatus 1 rotates the driving shaft 63 by the rotation driving force of the motor 77 to thereby move the moving mechanism 71. The transmitting mechanism 6 has the clutch 68 interposed between the motor 77 and the driving shaft 63. The clutch 68 is switched between the connected state in which the rotation driving force of the motor 77 is transmitted to the driving shaft 63 and the cutoff state in which the rotation driving force of the motor 77 is not transmitted to the driving shaft 63. Namely, the printing apparatus 1 is capable of providing the state that the movement of the moving mechanism 71 toward the first side is allowed by allowing the clutch 68 in the connected state, and of providing the state that the moving mechanism 71 is freely movable by allowing the clutch 68 to be in the cutoff state. Accordingly, by allowing the moving mechanism 71 to be in a freely movable state by the clutch 68, the printing apparatus 1 is capable of moving the moving mechanism 71 toward the second side with the force received by the moving mechanism 71 from the print medium 8 (see FIG. 9C). Further, the clutch 68 in the cutoff state cuts the driving shaft 63 off from the element of the clutch 68 on the side of the motor 77. Accordingly, by allowing the clutch 68 to be in the cutoff state, the printing apparatus 1 is capable of suppressing the resistance, generated when the moving mechanism 71 is being moved toward the second side by the force received by the moving mechanism 71 from the print medium 8, to be minimum. Thus, the printing apparatus 1 is capable of moving the moving mechanism 71 smoothly toward the second side by utilizing the force received by the moving mechanism 71 from the print medium 8.

The printing apparatus 1 determines whether the moving mechanism 71 is in the state of being arranged at the reference position, with the first sensor 41 and the second sensor 42 (S15, S19). In a case that the printing apparatus 1 determines that the moving mechanism 71 is in the state of being arranged at the reference position (S15: YES, S19: YES), the printing apparatus 1 allows the clutch 68 to be in the connected state (S21). In this case, since the printing apparatus 1 is capable of moving the moving mechanism 71 from the reference position toward the first side while the printing operation is being executed, the printing apparatus 1 is capable of performing the print image G at the desired position of the print medium 8 with high precision. Further, after the moving mechanism 71 has been arranged at the reference position and before the printing operation is started, the printing apparatus 1 allows the clutch 68 to be in the connected state. It can be said that this state is such a state that the moving mechanism 71 can quickly start to move toward the first side in response to the start of rotation of the motor 77 toward the one direction. Accordingly, in a case that the printing apparatus 1 determines that the print position velocity Wp is not more than the predetermined velocity Vth (S29: YES), the printing apparatus 1 is capable of shortening the time required until the movement of the moving mechanism 71 toward the first side is started. Accordingly, since the printing apparatus 1 is capable of suppressing occurrence of such a situation that the print position velocity Wp becomes to be not more than the predetermined velocity Vth, the printing apparatus 1 is capable of suppressing any lowering in the print quality which would be otherwise caused by the lowering in the print position velocity Wp.

The first detector 41A of the first sensor 41 is provided at such a position that the reference position Sb is included within the detecting range of the detector 41A. In a case that the end on the second side of the first supporting member 72A is arranged in the detecting range including the reference position Sb, the detector 41A detects the end on the second side of the first supporting member 72A. Due to this, in a case that the moving mechanism 71 is moved to the second side, there is such a possibility that even after the first detector 41A detects the end on the second side of the first supporting member 72A, the moving mechanism 71 has not reached the reference position and might be still moving toward the second side. On the other hand, in a case that the moving mechanism 71 is determined to be not moving, based on the signal output from the second sensor 42, this indicates that the moving mechanism 71 has reached the reference position and is stopped at the reference position. Accordingly, by using the first and second sensors 41 and 42, the printing apparatus 1 is capable of detecting, with a higher precision, that the moving mechanism 71 is located at the reference position. Accordingly, the printing apparatus 1 is capable of printing the print image G at the desired position of the print medium 8, with high precision.

<Modifications>

The present disclosure is not limited to or restricted by the above-described embodiment, and various changes can be made to the present disclosure. A plate-shaped platen may be provided, instead of the platen roller 29. In this case, in order that intermittent printing can be performed, it is desired that a guide configured to guide the thermal head 28 in the left-right direction, and a moving mechanism and a motor configured to move the thermal head 28 along the guide are provided on the inside of the casing 2A. For example, a linear encoder capable of directly specifying the position in the left-right direction of the moving mechanism 71 may be provided, instead of the second sensor 42. The linear encoder may have a light-emitting element, a light-receiving element, and a scale having a linear shape. For example, the light-emitting element and the light-receiving element may be provided on a front surface of the first supporting member 72A, namely, a surface, of the first supporting member 72A, which faces the first facing surface 13A of the first side wall 13. The scale may be provided on the first facing surface 13A of the first side wall 13. A light emitted from the light-emitting element may be reflected off the scale, and may be received by the light-receiving element. The linear encoder may specify the moving amount, of the first supporting member 72A, from the reference position with respect to the first side wall 13, based on the reflected light received by the light-receiving element. The controller 31 may specify the position of the moving mechanism 71, based on the specified moving amount from the reference position. The motor 77 may be rotatable only to the one direction. Namely, it is allowable that the motor 77 is capable of moving the moving mechanism 71 only to the first side. The timing at which the clutch 68 is allowed to be in the connected state by the processing of step S21 may be after receipt of the print instruction from the external apparatus 100. For example, the timing at which the clutch 68 is allowed to be in the connected state may be coincident to a timing at which the rotation of the motor 77 toward the one direction is started by the processing of steps S31. The timing at which the clutch 68 is allowed to be in the cutoff state by the processing of step S55 may be coincident to a timing at which the rotation of the motor 77 toward the one direction is stopped by the processing of steps S57, or may be after the rotation of the motor 77 is stopped.

The transmitting mechanism 6 transmits the rotation driving force of the motor 77 to the moving mechanism 71 by rotating, with the driving shaft 63, the pinion gear 62 meshing with the rack gear 61. The transmitting mechanism 6 may have another configuration. For example, the transmitting mechanism 6 may rotate an annular belt connected to the moving mechanism 71 by a pulley connected to the driving shaft 63, thereby moving the moving mechanism 71. The clutch 68 is not limited to or restricted by the electromagnetic clutch, and may be a clutch of another system (for example, a claw clutch, a friction clutch, a fluid clutch, etc.). It is allowable that a pinion gear (sprocket) is provided, instead of the first pulley 64 and the second pulley 65. In this case, it is allowable that the two gears mesh with each other, or that an annular chain or rack gear is provided, instead of the belt, as a member configured to connect the two gears.

The timing at which the clutch 68 is allowed to be in the connected state by the processing of step S21 may be before the timing at which the moving mechanism 71 is arranged at the reference position by the processing of steps S13 to S19. In this case, by stopping the electrification to the motor 77, the driving shaft 63 becomes rotatable even in the state that the clutch 68 is allowed to be in the cutoff state. Accordingly, the printing apparatus 1 is capable of moving the moving mechanism 71 toward the second side to the reference position by utilizing the force received by the moving mechanism 71 from the print medium 8.

The printing apparatus 1 may determine whether the moving mechanism 71 is arranged at the reference position, based only on the signal output from the first sensor 41. Namely, it is allowable that the controller 31 executes only the determinations by the processing of step S13 and the processing of step S15, and does not execute the determinations by the processing of step S17 and the processing of step S19. Alternatively, the printing apparatus 1 may determine whether the moving mechanism 71 is arranged at the reference position, based only on the signal output from the second sensor 42. Namely, it is allowable that the controller 31 executes only the determinations by the processing of step S17 and the processing of step S19, and does not execute the determinations by the processing of step S13 and the processing of step S15.

In a case that the controller 31 determines that the state that a continuous time during which the platen roller 29 is not rotating is continued for the second predetermined time (S19: YES), the controller 31 determines that the moving mechanism 71 has reached the reference position and has stopped (S19: YES). In view of this, in a case that the platen roller 29 is not rotating, the controller 31 may determine that the moving mechanism 71 has reached the reference position and has stopped, regardless of the continuous time during which the state that the platen roller 29 is not rotating is continued.

The second sensor 42 may be disposed in the vicinity of the third roller 76C or the fourth roller 76D. The circumferential end part or portion of the rotating plate 42B of the second sensor 42 may make contact with the circumferential surface of the third roller 76C or the fourth roller 76D. The second sensor 42 may output a signal in accordance with the rotation of the third roller 76C or the fourth roller 76D to the controller 31. Note that the each of the third roller 76C and the fourth roller 76D is located between the first roller 73A and the second roller 73B in the medium path P. Accordingly, in a case that the print medium 8 is moved by the movement of the moving mechanism 71, each of the third roller 76C and the fourth roller 76D is rotated by the friction between itself and the print medium 8. Accordingly, even in a case that the second sensor 42 is attached to the third roller 76C or the fourth roller 76D, the second sensor 42 is capable of outputting the signal in accordance with the movement of the moving mechanism 71. Further, the ratio of the diameter of the third roller 76C or the fourth roller 76D to the diameter of the platen roller 29 is already known. Thus, it can be said that, even in a case that the second sensor 42 is attached to the third roller 76C or the fourth roller 76D, the second sensor 42 is capable of indirectly detecting the rotation amount of the platen roller 29 to thereby output the signal in accordance with the rotation amount of the platen roller 29.

The second sensor 42 outputs the signal in accordance with the rotation amount of the platen roller 29, thereby functioning as a sensor capable of detecting the movement (the moving amount, the moving velocity, the presence or absence of the movement) of the moving mechanism 71. Namely, the second sensor 42 indirectly specifies the movement of the moving mechanism 71 by detecting the rotation amount of the platen roller 29. In view of this, for example as depicted in FIG. 18, the printing apparatus 1 may be provided with a rotary encoder 43, instead of the second sensor 42. The rotary encoder 43 may be arranged in front of (on the front side with respect to) the clutch 68, and may be connected to the driving shaft 63. The rotary encoder 43 may output, to the controller 31, a signal in accordance with the rotation of the driving shaft 63. Note that the pinion gear 62 is rotated in accordance with the rotation of the driving shaft 63, and the supporting member 72 on which the rack gear 61 meshing with the pinion gear 62 is provided is moved in the left-right direction. Namely, the controller 31 may directly specify the movement of the moving mechanism 71 by the rotary encoder 43. For example, in a case that the controller 31 executes the processing of step S17 and the processing of step S19, the controller 31 may detect the signal output from the rotary encoder 43 (S17). In a case that the controller 31 determines that the driving shaft 63 is not rotating continuously for the second predetermined time based on the signal output from the rotary encoder 43, the controller 31 may determine that the moving mechanism 71 is in a state of being arranged at the reference position. This can be similarly applied to the processing of step S77 and the processing of step S79, as well.

The first sensor 41 is provided on the end on the second side of the moving range S of the moving mechanism 71. More specifically, the first sensor 41 is provided at such a position that the reference position Sb is included within the detecting range of the detector 41A. In view of this, the position at which the first sensor 41 is arranged may be appropriately changed within the range satisfying the condition that the reference position Sb is included in the detecting range of the detector 41A. Accordingly, it is allowable that for example, a part or portion, of the first sensor 41, which is different from the detector 41A is not arranged at the end on the second side of the moving range S of the moving mechanism 71.

What is claimed is:

1. A printing apparatus comprising:

a frame;

a platen supported by the frame and configured to face a thermal head;

a moving mechanism supported by the frame, the moving mechanism being movable in a moving range along a specified direction, the moving mechanism comprising:

a first roller positioned upstream of the platen in a conveyance path of a print medium;

a second roller positioned downstream of the platen in the conveyance path; and a supporting member rotatably supporting the first roller and the second roller, the moving mechanism being configured such that a part, of the conveyance path, between the platen and the first roller becomes shorter in a case that the moving mechanism is moved toward a first side in the specified direction, and the part, of the conveyance path, between the platen and the first roller becomes longer in a case that the moving mechanism is moved toward a second side, opposite to the first side, in the specified direction;

a motor provided on the frame;

a transmitting mechanism connected to the motor and the moving mechanism, the transmitting mechanism being configured to move the moving mechanism toward the first side in accordance with driving of the motor in one direction;

a clutch provided on the transmitting mechanism, the clutch transmitting a driving force of the motor to the moving mechanism in a case that the clutch is in a connected state, and the clutch not transmitting the driving force to the moving mechanism in a case that the clutch is in a cutoff state;

a communication interface configured to perform communication with an external apparatus; and a controller configured to execute:

starting the driving of the motor toward the one direction in a state that the clutch is in the connected state, after receiving a print signal from the external apparatus via the communication interface, the print signal indicating that the print medium is located at a printable position, and allowing the clutch to be in the cutoff state, after ending of printing and before arrival of the moving mechanism at an end on the second side of the moving range, the printing being performed in response to the receiving of the print signal via the communication interface.

2. The printing apparatus according to claim 1, wherein the controller starts the driving of the motor in the one direction after allowing the clutch to be in the connected state.

3. The printing apparatus according to claim 1, wherein the transmitting mechanism comprises:

a rack gear provided on the supporting member;

a pinion gear configured to mesh with the rack gear;

a driving shaft connected to the pinion gear and rotatably supported by the frame, the driving shaft being configured to rotate about a first rotation axis orthogonal to the specified direction, in accordance with the driving force of the motor; and a gear or pulley provided coaxially with the driving shaft and to which the driving force of the motor is transmitted, wherein the clutch has a first part to which the driving shaft is fixed and a second part to which the gear or the pulley is fixed, and the clutch is configured such that the driving force is transmitted between the first part and the second part under a condition that the clutch is in the connected state, and that the driving force is not transmitted between the first part and the second part under a condition that the clutch is in the cutoff state.

4. The printing apparatus according to claim 1, further comprising a sensor configured to detect a position of the moving mechanism and to output a signal in accordance with the detected position, wherein the controller determines whether the moving mechanism is located at the end on the second side of the moving range, based on the signal output from the sensor, and the controller allows the clutch to be in the connected state under a condition that the controller determines that the moving mechanism is located at the end on the second side of the moving range.

5. The printing apparatus according to claim 4, wherein the sensor comprises:

a first sensor provided on the end on the second side of the moving range, the first sensor being configured to detect the moving mechanism in accordance with proximity or contact of the moving mechanism with respect to the first sensor; and a second sensor configured to detect movement of the moving mechanism, and the controller determines that the moving mechanism is located at the end on the second side of the moving range, under a condition that the first sensor detects the moving mechanism and that the second sensor does not detect the movement of the moving mechanism.

6. The printing apparatus according to claim 1, further comprising:

a casing attached to the frame; and the thermal head arranged inside the casing.

7. A printing method comprising:

starting driving of a motor in one direction in a state that a clutch provided on a transmitting mechanism is in a connected state and moving a moving mechanism toward a first side in a specified direction, after receipt of a print signal from an external apparatus, the moving mechanism being movable in a moving range along the specified direction, the print signal indicating that a print medium is located at a printable position, the transmitting mechanism connecting the moving mechanism and the motor, the moving mechanism comprising: a first roller positioned upstream of a platen in a conveyance path of the print medium, and a second roller positioned downstream of the platen in the conveyance path, the platen facing a thermal head, the moving mechanism being configured such that a part, of the conveyance path, between the platen and the first roller becomes shorter in a case that the moving mechanism is moved toward the first side in the specified direction, and the part, of the conveyance path, between the platen and the first roller becomes longer in a case that the moving mechanism is moved toward a second side, opposite to the first side, in the specified direction; and allowing the clutch to be in a cutoff state, after ending of printing and before arrival of the moving mechanism at an end on the second side of the moving range, the printing being performed in response to the receipt of the print signal via a communication interface.

8. A non-transitory computer readable storage medium storing a printing program for causing a computer of a printing apparatus to execute:

starting driving of a motor in one direction in a state that a clutch provided on a transmitting mechanism is in a connected state and moving a moving mechanism toward a first side in a specified direction, after receipt of a print signal from an external apparatus, the moving mechanism being movable in a moving range along the specified direction, the print signal indicating that a print medium is located at a printable position, the transmitting mechanism connecting the moving mechanism and the motor, the moving mechanism comprising: a first roller positioned upstream of a platen in a conveyance path of the print medium, and a second roller positioned downstream of the platen in the conveyance path, the platen facing a thermal head, the moving mechanism being configured such that a part, of the conveyance path, between the platen and the first roller becomes shorter in a case that the moving mechanism is moved toward the first side in the specified direction, and the part, of the conveyance path, between the platen and the first roller becomes longer in a case that the moving mechanism is moved toward a second side, opposite to the first side, in the specified direction; and allowing the clutch to be in a cutoff state, after ending of printing and before arrival of the moving mechanism at an end on the second side of the moving range, the printing being performed in response to the receipt of the print signal via a communication interface.

* * * * *